US011636839B2

(12) United States Patent
Ohtsu et al.

(10) Patent No.: US 11,636,839 B2
(45) Date of Patent: Apr. 25, 2023

(54) SOUNDPROOF STRUCTURE BODY

(71) Applicant: FUJIFILM Corporation, Tokyo (JP)

(72) Inventors: Akihiko Ohtsu, Kanagawa (JP); Yoshihiro Sugawara, Kanagawa (JP); Shinya Hakuta, Kanagawa (JP); Shogo Yamazoe, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 441 days.

(21) Appl. No.: 17/039,072

(22) Filed: Sep. 30, 2020

(65) Prior Publication Data

US 2021/0012762 A1 Jan. 14, 2021

Related U.S. Application Data

(63) Continuation of application No. PCT/JP2019/015634, filed on Apr. 10, 2019.

(30) Foreign Application Priority Data

Apr. 18, 2018 (JP) ..... JP2018-080223

(51) Int. Cl.
*G10K 11/172* (2006.01)
*F24F 13/24* (2006.01)
*F24F 13/02* (2006.01)

(52) U.S. Cl.
CPC ..... *G10K 11/172* (2013.01); *F24F 13/24* (2013.01); *F24F 13/02* (2013.01); *F24F 2013/242* (2013.01); *F24F 2013/245* (2013.01)

(58) Field of Classification Search
CPC .. G10K 11/172; F24F 13/24; F24F 2013/242; F24F 2013/245; F24F 13/02
See application file for complete search history.

(56) References Cited

U.S. PATENT DOCUMENTS

2017/0219153 A1 8/2017 Hill et al.
2019/0115005 A1* 4/2019 Pauley ..... G10K 11/172
(Continued)

FOREIGN PATENT DOCUMENTS

JP 10-187162 A 7/1998
JP 2944552 B2 9/1999
(Continued)

OTHER PUBLICATIONS

International Preliminary Report on Patentability and Written Opinion of the International Searching Authority (Forms PCT/IB/326, PCT/IB/373 and PCT/ISA/237) for International Application No. PCT/JP2019/015634, dated Oct. 29, 2020, with English translation of the Written Opinion.
(Continued)

*Primary Examiner* — Forrest M Phillips
(74) *Attorney, Agent, or Firm* — Birch, Stewart, Kolasch & Birch, LLP

(57) ABSTRACT

Provided is a soundproof structure body including an opening member that forms an opening tube line having a cross-sectional area S, and at least two resonance structures for sound waves that are installed inside the opening tube line, and in a case where a cross-sectional area of the resonance structure is defined as Si, a width thereof is defined as di, an interval between the two resonance structures is defined as L, an impedance of the two resonance structures is defined as Zi, and a synthetic acoustic impedance is defined as Zc, a condition of Expression (1) is satisfied at a resonance frequency f0 at which a theoretical absorption value At is a maximum value. This soundproof structure body can realize high absorption using a plurality of resonance structures.

$$At(f0, L, S, Si, di, Zi)>0.75 \quad (1),$$

Here, L>0, S>0, Si (i=1, 2)>0, di (i=1, 2)>0

10 Claims, 16 Drawing Sheets

(56) References Cited

U.S. PATENT DOCUMENTS

| | | | | |
|---|---|---|---|---|
| 2020/0200433 | A1* | 6/2020 | Ku | B41J 29/10 |
| 2020/0202832 | A1* | 6/2020 | Tabrizian | H03H 9/0095 |
| 2020/0234687 | A1* | 7/2020 | Ohtsu | F16L 55/0336 |

FOREIGN PATENT DOCUMENTS

| | | | |
|---|---|---|---|
| JP | 2005-315087 | A | 11/2005 |
| JP | 2016-170194 | A | 9/2016 |
| JP | 2016-194682 | A | 11/2016 |
| JP | 2017-531143 | A | 10/2017 |

OTHER PUBLICATIONS

International Search Report (Form PCT/ISA/210) for International Application No. PCT/JP2019/015634, dated Jul. 2, 2019.

European Communication pursuant to Article 94(3) EPC for corresponding European Application No. 19787586.7, dated Aug. 22, 2022.

Extended European Search Report for corresponding European Application No. 19787586.7, dated May 14, 2021.

* cited by examiner

SOUNDPROOF STRUCTURE BODY

CROSS-REFERENCE TO RELATED APPLICATIONS

This application is a Continuation of PCT International Application No. PCT/JP2019/015634 filed on Apr. 10, 2019, which claims priority under 35 U.S.C. § 119(a) to Japanese Patent Application No. 2018-080223 filed on Apr. 18, 2018. Each of the above applications is hereby expressly incorporated by reference, in its entirety, into the present application.

BACKGROUND OF THE INVENTION

1. Field of the Invention

The present invention relates to a soundproof structure body capable of realizing high absorption using a plurality of resonance structures.

2. Description of the Related Art

Conventionally, structures such as ducts, ventilation sleeves, and mufflers, which are premised on ensuring air permeability, allow sound together with gas and/or heat to pass. Therefore, noise countermeasures may be required. Thus, in applications for particularly attaching ducts, ventilation sleeves, or the like to machines with noise, it is necessary to provide soundproofing in devising the structures of the ducts, the ventilation sleeves, and the like. Generally, in a case of reducing a peak sound, it is considered as one of the countermeasures to place or attach a resonance type soundproof structure body (a resonance body such as a Helmholtz resonator, an air column resonance cylinder, and a film vibration type structure) into a duct, a ventilation sleeve, or the like, in order to obtain a high transmission loss at a desired frequency (see JP2016-170194A and JP2944552B).

Therefore, as a sound absorbing structure described in JP2016-170194A, a plurality of sound absorbing bodies having sound absorbing peak frequencies different from each other are disposed in the duct, whereby a sound absorbing effect can be enhanced even though noise frequency bands different from one another exist.

On the other hand, a silencer disclosed in JP2944552B has two resonators that resonate in a frequency band to be silenced and that are disposed on an upstream side and a downstream side respectively, the upstream side being an upstream side position in a sound propagation direction in an air channel and the downstream side being a downstream side position in the sound propagation direction in the air channel, in which the two resonators have resonant openings to be opened, respectively, an interval between the resonant openings of the two resonators is an interval in which the resonant opening of the resonator on the upstream side faces toward a position at which sound pressure in the frequency band to be silenced increases due to interference between sound propagated from a sound source and sound reflected from the resonator on the downstream side, and the resonator on the upstream side is a resonator provided with sound absorbability due to a resistance component of an impedance. In addition, the interval L between the resonant opening of the resonator on the upstream side and the resonant opening of the resonator on the downstream side is set to a value given by Expression $L=(2n-1)\cdot\lambda/4$ (n is a natural number) with respect to a wavelength λ of sound at a specific frequency in the frequency band to be silenced.

As a result, in the silencer described in JP2944552B, a high silencing effect even for sound in a low frequency band can be obtained. Furthermore, there is a small increase in ventilation resistance, and the high silencing effect can be stably obtained without receiving an influence of acoustic characteristics on an air channel structure.

SUMMARY OF THE INVENTION

In the sound absorbing structure described in JP2016-170194A, in the duct, the plurality of sound absorbing bodies having sound absorbing peak frequencies different from each other are used to absorb noise frequency bands different from each other. However, the interval and the like between the sound absorbing bodies are not taken into consideration, and higher optimal sound absorbing effect could not be achieved.

In addition, it is described in the silencer described in JP2944552B that two resonators are provided, and a resonator on an upstream side is placed at a location where the sound pressure is high due to the interference between a reflected wave from a resonator on a downstream side and an incident wave, but no ranges thereof are clearly specified.

In particular, the interval between the two resonators is set to $(2n-1)\lambda/4$ (see claim 9); however, it was found from our study that the above condition is not the only condition for necessarily exhibiting a high absorbance.

That is, in order to obtain high absorption, there are appropriate intervals to be placed depending on the impedance of a resonator. However, in JP2944552B, there are problems that an impedance Zi of the resonator and a relationship between the interval L and an absorbance A of the resonator are not specified and that an impedance and a strict analytic expression with a resonator interval and an absorbance for obtaining high absorption are not clear.

In order to confirm the essence of the technique described in JP2944552B, the present inventors performed theoretical calculation by changing an inner diameter of a duct 52*a* and using a theoretical expression derived from a transfer matrix described later, on a silencer 50 shown in FIG. 17.

In the silencer 50 shown in FIG. 17, two same-shaped Helmholtz resonators 54*a* and 54*b* are disposed on a tube wall 52*a* of the duct 52 having a cross-sectional area S so that the interval L exists between both resonant openings 56*a* and 56*b*.

Here, in the prior art example 1, the inner diameter of the duct 52 was 3 cmΦ and the cross-sectional area was 707 $mm^2$, in the prior art example 2, the inner diameter of the duct 52 was 4 cmΦ and the cross-sectional area was 1257 $mm^2$, and in the prior art example 3, the inner diameter of the duct 52 was 9 cmΦ and the cross-sectional area was 6362 $mm^2$.

In other various parameters, each of areas Sn of the resonant openings 56*a* and 56*b* of the two resonators 54*a* and 54*b* having the same structure was 49 $mm^2$, each of neck lengths l1 of the resonant openings 56*a* and 56*b* was 5 mm, and each of internal volumes V1 in internal hollow spaces 58*a* and 58*b* of the resonators 54*a* and 54*b* was 4000 $mm^3$.

Here, the absorbance was calculated with an X axis as a frequency (Hz) and a Y axis as a distance (interval) L(m) between the resonant openings 56*a* and 56*b* of the two resonators 54*a* and 54*b*. As a result, two-dimensional graphs illustrating the absorbance by concentration are shown in FIGS. 18 to 20.

An impedance real part (impedance resistance described in JP2944552B) and an impedance imaginary part (reactance component) in a single structure of the resonators 54*a* and 54*b* in the prior art examples 1 to 3 each are standardized and represented as respective solid lines and broken lines in the graphs shown in FIGS. 21 to 23. An impedance value (synthetic acoustic impedance Zc) can be obtained by substituting Expression (8) of an impedance Z of the Helmholtz resonator 54*a* or 54*b* described later into Expression (17) described later. Z.re is the impedance real part (impedance resistance) of the impedance value, Z.im is the impedance imaginary part (reactance component) of the impedance value, and Z.re/Z0 and Z.im/Z0 are values obtained by dividing each of the impedance real part Z.re and the impedance imaginary part Z.im by an impedance Z0 of a tube line to be dimensionless.

Here, at a resonance frequency, that is, a frequency around 1760 Hz at which the impedance real part has a minimum value, the values of the impedance real part of the resonators 54*a* and 54*b* in the prior art are values between 0.1 and 6.0, that is, it is designed to satisfy the requirement claimed in claim 2 of the prior art 2.

As apparent from FIGS. 18 to 20, a peak frequency was around 1760 Hz. At this time, the wavelength λ is 0.195 (m), and the length corresponding to λ/4 is 0.049 (m). In the case of the prior art example 3 including an air channel of the duct 52 having the inner diameter of 9 cmΦ, the interval between the resonant openings 56*a* and 56*b* of the resonators 54*a* and 54*b* is (2n−1)λ/4, and generally, a high absorbance is obtained. However, it was found that in the case of the prior art example 2 including an air channel of the duct 52 having the inner diameter of 4 cmΦ and the prior art example 1 including an air channel of the duct 52 having the inner diameter of 3 cmΦ, absorption at a frequency of L=(2n−1)λ/4 is not the highest absorption.

In JP2944552B, only the reflection from a side-branch resonator is considered. However, it may be difficult to use the side-branch type (for example, from the viewpoint that construction work or the like is required later) in a case where a structure such as a duct is required to be incorporated later. In this case, an incorporated type is required to be used.

However, in the case of using the incorporated type, not only reflection of a resonance structure but also reflection from a discontinuous cross-section of an area without air channels, which is generated by inserting the structure, may be increased.

In addition, it is described in JP2944552B that in order to increase the absorbance, in a case where the interval L between the two resonators is L=(2n−1)λ/4, an absorbance A2 of sound to be silenced has a maximum value.

That is, in order to obtain high absorption, at least about a quarter of the wavelength of the subject sound is necessary, which is not suitable for miniaturization.

An object of the present invention is to provide a soundproof structure body that overcomes the above described problems of the related arts and can realize high absorption by using a plurality of resonance structures.

Specifically, an object of the present invention is to provide a soundproof structure body in which in a case of using a plurality of resonance structures, an impedance for obtaining high absorption and a relationship between a resonator interval and an absorbance can be specified, a condition for exhibiting the high absorbance can be obtained, and as a result, it is possible to decrease a size and to obtain high absorption.

In order to achieve the above object, a soundproof structure body of the present invention including an opening member that forms an opening tube line having a cross-sectional area S, and at least two resonance structures for sound waves that are installed inside the opening tube line, in which a cross-sectional area Si (i=1, 2, . . . , where the resonance structure having a smaller i number is located on an upstream side) in the opening tube line and a width di (i=1, 2, . . . ) of the resonance structure in a waveguide forward direction are 0 or more, at least two resonance structures among the resonance structures are installed to be spaced apart at an interval L (L>0) from each other, and in a case where an impedance of each of the two resonance structures installed to be spaced apart at the interval L from each other is defined as Zi (i=1, 2), and a synthetic acoustic impedance, in which the two resonance structures and the interval thereof, a change in the cross-sectional area in the waveguide forward direction, and the two resonance structures are considered, is defined as Zc, a condition of Expression (1) is satisfied at a resonance frequency f0 at which a theoretical absorption value At given by Expression (2) is a maximum value.

$$At(f0, L, S, Si, di, Zi)>0.75 \tag{1}$$

Here, in a case where L>0, S>0, Si (i=1, 2)>0, di (i=1, 2)>0, and, f, L, S, Si, di, Zi (i=1, 2) is represented by x, $$At(x)=1-|(Zc(x)-Z0)/(Zc(x)+Z0)|^2-|2/(Ac(x)+Bc(x)/Z0+Z0Cc(x)+Dc(x))|^2 \tag{2}$$

Here, the synthetic acoustic impedance Zc (x) is defined by Expression (3).

$$Zc(x)=\frac{Z_0A_C(x)+B_C(x)}{Z_0C_C(x)+D_C(x)} \tag{3}$$

Z0 is an acoustic impedance of an opening tube line represented by Zair/S Z0) (S denotes a tube line cross-sectional area).

Zair denotes an acoustic impedance of air and is given by Zair=ρc. ρ denotes a density of air (for example, 1.205 kg/m$^2$ (room temperature))(20°) and c denotes a speed of sound (343 msec (room temperature)) (20°).

Ac(x), Bc(x), Cc(x), and Dc(x) are elements of a synthetic transfer matrix, and are defined by Expression (4). Tc is a synthetic transfer matrix of the two resonance structures.

$$T_C=T_{d1/2}T_1T_{d1/2}T_{L-d1/2-d2/2}T_{d2/2}T_2T_{d2/2}=\begin{pmatrix}A_C(x) & B_C(x)\\ C_C(x) & D_C(x)\end{pmatrix} \tag{4}$$

$T_i$ (i=1, 2) is a transfer matrix corresponding to a resonance structure in each of the two resonance structures, and is defined by Expression (5).

$$T_i=\begin{pmatrix}1 & 0\\ \frac{1}{z_i} & 1\end{pmatrix} \tag{5}$$

$T_{di/2}$ is a transfer matrix corresponding to a distance of a resonance structure in each of the two resonance structures, and is defined by Expression (6).

$$T_{di/2} = \begin{pmatrix} \cos k\frac{d}{2} & i\frac{Z_{air}}{S-S_i}\sin k\frac{d}{2} \\ i\frac{S-S_i}{Z_{air}}\sin k\frac{d}{2} & \cos k\frac{d}{2} \end{pmatrix} \quad (6)$$

$(i = 1, 2)$ $T_{L-d1/2-d2/2}$ is a transfer matrix corresponding to a distance between the two resonance structures and is defined by Expression (7).

$$T_{L-d1/2-d2/2} = \begin{pmatrix} \cos k\left(L-\frac{d_1}{2}-\frac{d_2}{2}\right) & i\frac{Z_{air}}{S}\sin k\left(L-\frac{d_1}{2}-\frac{d_2}{2}\right) \\ i\frac{S}{Z_{air}}\sin k\left(L-\frac{d_1}{2}-\frac{d_2}{2}\right) & \cos k\left(L-\frac{d_1}{2}-\frac{d_2}{2}\right) \end{pmatrix} \quad (7)$$

Here, k denotes a wave number and is given by $k=2\pi/\lambda=2\pi C/f$. Here, $\lambda$ is a wavelength and f is a frequency.

Here, it is preferable that a resonance frequency of the resonance structure located on the upstream side in the waveguide forward direction is set to be different from a resonance frequency of the resonance structure located on a downstream side, out of the two resonance structures.

It is preferable that a resonance frequency of the resonance structure located on the upstream side in the waveguide forward direction is higher than a resonance frequency of the resonance structure located on a downstream side, out of the two resonance structures.

In a case where a wavelength of the resonance frequency f0 is denoted by $\lambda(f0)$, the interval L preferably satisfies $L<\lambda(f0)/4$.

The two resonance structures are preferably integrated.

At least two resonance structures are preferably three or more resonance structures.

It is preferable that at least one resonance structure of the at least two resonance structures is a Helmholtz resonance structure.

It is preferable that at least one resonance structure of the at least two resonance structures is a film resonance structure.

It is preferable that at least one resonance structure of the at least two resonance structures is an air column resonance structure.

It is preferable that with respect to a wavelength $\lambda(f0)$ of a frequency satisfying Expression (1), the cross-sectional area S of the opening tube line satisfies $S<\pi(\lambda/2)^2$ is satisfied.

According to the present invention, it is possible to realize high absorption using a plurality of resonance structures.

According to the present invention, in a case of using a plurality of resonance structures, an impedance for obtaining high absorption and a relationship between a resonator interval and an absorbance can be specified, a condition for exhibiting the high absorbance can be obtained, and as a result, and as a result, it is possible to decrease a size and to obtain high absorption.

DESCRIPTION OF THE PREFERRED EMBODIMENTS

Figure 1:
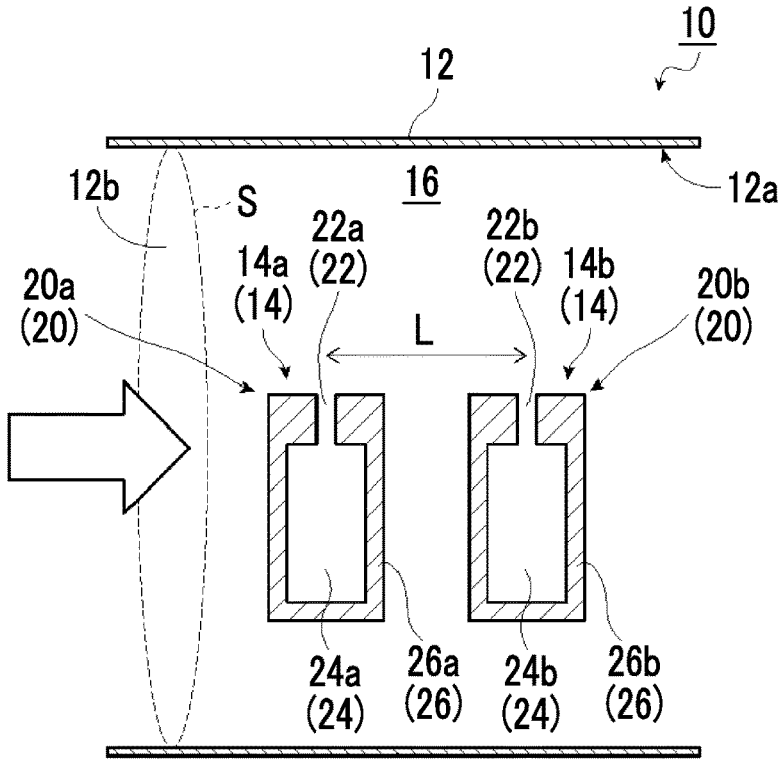
FIG. 1 is a cross-sectional view schematically showing an example of a soundproof structure body according to an embodiment of the present invention.

Hereinafter, a soundproof structure body according to an embodiment of the present invention will be described in detail with reference to suitable embodiments shown in the accompanying diagrams.

The following description of components may be made based on representative embodiments of the present invention, but the present invention is not limited to the embodiments.

In the present specification, the numerical range expressed by using "to" means a range including numerical values described before and after "to" as a lower limit value and an upper limit value.

A soundproof structure body according to an embodiment of the present invention including: an opening tube line having a cross-sectional area S; and at least two resonance structures for sound waves that are installed inside the opening tube line, in which a cross-sectional area Si (i=1, 2, . . . , where the resonance structure having a smaller i number is located on an upstream side) in the opening tube line and a width di (i=1, 2, . . . ) of the resonance structure in a waveguide forward direction are 0 or more, at least two resonance structures among the resonance structures are installed to be spaced apart at an interval L (L>0) from each other, and in a case where an impedance of each of the two resonance structures installed to be spaced apart at the interval L from each other is defined as Zi (i=1, 2), and a synthetic acoustic impedance, in which the two resonance structures and the interval thereof, a change in the cross-sectional area in the waveguide forward direction, and the two resonance structures are considered, is defined as Zc, a condition of Expression (1) is satisfied at a resonance frequency f0 at which a theoretical absorption value At given by Expression (2) is a maximum value. Here, the "resonance structure" refers to a structure that resonates with a sound wave of any frequency in an audible range, and the "resonate" refers to a resonance absorption peak that appears in a four-microphone acoustic tube measurement specified in Examples described later. In addition, the "waveguide" refers to a path through which a sound wave propagates, and the "waveguide forward direction" refers to a direction in which a sound wave propagates (a sound propagation direction) or a direction in which a sound wave travels (a traveling direction of sound).

$$At(f0, L, S, Si, di, Zi)>0.75 \quad (1)$$

Here, in a case where L>0, S>0, Si (i=1, 2)>0, di (i=1, 2)>0, and, f, L, S, Si, di, Zi (i=1, 2) is represented by x, $$At(x)=1-|(Zc(x)-Z0)/(Zc(x)+Z0)|^2-|2/(Ac(x)+Bc(x)/Z0+Z0Cc(x)+Dc(x))|^2 \quad (2).$$

In the present invention, it is possible to specify a structure for realizing high absorption in a case of using a plurality of resonance structures.

In addition, in the present invention, conditions for obtaining high absorption can be obtained. That is, high absorption can be obtained by suppressing reflected waves and transmitted waves. Specifically, a theoretical absorption value in a case where two or more resonance structures are installed at the same time in the opening tube line is obtained from theoretical analysis of the transfer matrix, and design conditions for obtaining high absorption can be specified.

In addition, miniaturization can be realized by shifting the two resonance frequencies of the two resonance structures.

In the present invention, a parameter range in which an absorbance increases can be given as a strict analytical solution.

In the present invention, it is possible to specify a structural parameter range in which high absorption is given in consideration of reflection from a discontinuous cross-section.

First, the soundproof structure body according to the embodiment of the present invention will be described in detail.

(Soundproof Structure Body)

FIG. 1 is a cross-sectional view schematically showing an example of a soundproof structure body according to an embodiment of the present invention.

The soundproof structure body 10 shown in FIG. 1 includes a circular tubular body 12 having a circular cross-section, which is an opening member, and resonance structures 14 (14*a* and 14*b*) that are installed to be spaced apart at an interval L from each other in an opening tube line 12*a* of the tubular body 12. Here, the two resonance structures 14*a* and 14*b* are installed at a position parallel to a waveguide forward direction (a traveling direction of a sound wave) in the opening tube line 12*a* (a position inclined by 90° with respect to the opening cross-section 12*b*) or installed at a position inclined by a predetermined angle, for example, ±45° from the parallel position, and have a structure in which the resonance structures are disposed in a state where a region serving as a venthole 16 through which gas passes is provided in the opening tube line 12*a* in the tubular body 12.

In the present invention, the opening cross-section of the opening member is defined as an area of a cross-section of the opening tube line of the tubular body perpendicular to the waveguide forward direction (the traveling direction of the sound wave) in the opening member (tubular body). In addition, the cross-sectional area in the opening tube line in the waveguide forward direction of the resonance structure is considered to be a plane orthogonal to a waveguide forward direction vector in the opening member (tubular body), and the plane is defined as a plane intersecting with the resonance structure.

In addition, the interval L between the two resonance structures is defined as a distance between centers of planes on which sound waves are incident in the resonance structures. The "centers of planes on which sound waves are incident" are, for example, a center of a resonance hole in a Helmholtz structure, a center of a film surface in a film structure, and a center of a hole portion in an air column resonance structure.

Figure 2:
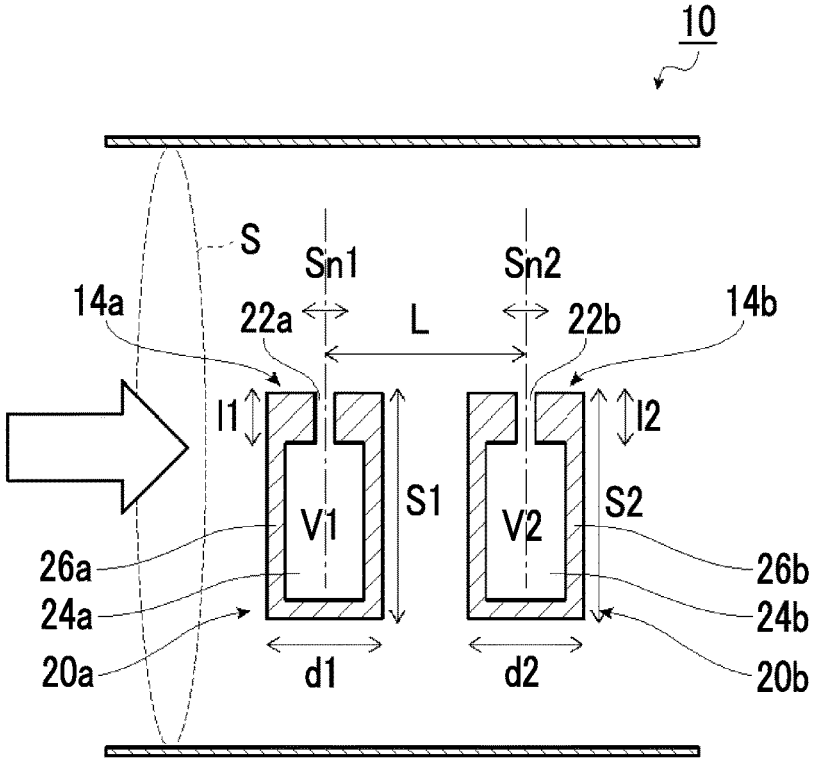
FIG. 2 is an illustration diagram showing symbols representing sizes of each part of a duct and a resonator in the schematic cross-sectional view of the soundproof structure body shown in FIG. 1.

Although in the soundproof structure body 10 shown in FIGS. 1 and 2, the two resonance structures 14*a* and 14*b* are installed in the opening tube line 12*a* in the tubular body 12, the present invention is not limited thereto, and three or more resonance structures 14 may be installed. Even in a case where three or more resonance structures 14 are installed, at least two of the resonance structures 14 among the three or more resonance structures form a pair such as the two resonance structures 14*a* and 14*b* shown in FIG. 1, and it is necessary to satisfy requirements of the present invention described later.

In the soundproof structure body 10 shown in FIG. 1, the respective resonance frequencies of the two resonance structures 14*a* and 14*b* are not particularly limited as long as the resonance frequencies are determined according to soundproofing targets. Here, the resonance frequencies of the two resonance structures 14*a* and 14*b* are preferably different from each other, and may be the same each other as long as the requirements of the present invention described later are satisfied.

Soundproofing targets to which the soundproof structure body 10 according to the embodiment of the present invention is applied for soundproofing is not particularly limited and may be any object, and examples thereof can include a copying machine, a blower, an air conditioning machine, a ventilator, pumps, a generator, a duct, industrial equipment, for example, various kinds of manufacturing devices emitting a sound such as a coater, a rotating machine, and a carrier machine, transportation equipment such as an automobile, an electric train, and an aircraft, and general household equipment such as a refrigerator, a washing machine, a dryer, a television, a copier, a microwave, a game machine, an air conditioner, a fan, a personal computer, a vacuum cleaner, and an air cleaner.

(Opening Member)

Here, although the tubular body 12 is an opening member formed in a region of an object that blocks the passage of gas, a tube wall of the tubular body 12 forms a wall of an object that blocks the passage of gas, for example, an object separating two spaces from each other, and the like, and an inside of the tubular body 12 is formed with the opening tube line 12*a* formed in a region of a part of the object that blocks the passage of gas.

It can be said that the opening cross-section 12*b* is a cross-section of the opening tube line 12*a* of the tubular body 12 orthogonal to an axial direction of the tubular body 12. Since a sound wave traveling in the tubular body 12 travels along the axial direction of the tubular body 12, it can be said that the opening cross-section 12*b* is a cross-section of the opening tube line 12*a* of the tubular body 12 perpendicular to the waveguide forward direction (the traveling direction of the sound wave).

In the present invention, the opening member has an opening formed in the region of the object that blocks the passage of gas, and it is preferable that the opening member is provided in a wall separating two spaces from each other.

Here, the object that has a region where an opening such as the opening tube line is formed and that blocks the passage of gas refers to a member, a wall, and the like separating two spaces from each other. The member refers to a member, such as a tubular body and a cylindrical body, such as a duct or a sleeve. The wall refers to, for example, a fixed wall forming a building structure such as a house, a building, and a factory, a fixed wall such as a fixed partition disposed in a room of a building to partition the inside of the room, or a movable wall such as a movable partition disposed in a room of a building to partition the inside of the room.

The opening member of the present invention may be a tubular body or a cylindrical body, such as a duct or a sleeve, may be a wall itself having an opening for attaching a ventilation hole, such as a louver or a gully, or a window, or may be a mounting frame, such as a window frame attached to a wall.

Although a shape of an opening of the opening member of the present invention is a circle in a cross-sectional shape in an illustrated example, in the present invention, the shape of the opening of the opening member is not particularly limited as long as the resonance structures can be disposed in the opening. For example, the shape of the opening of the opening member may be a quadrangle such as a square, a rectangle, a diamond, or a parallelogram, a triangle such as an equilateral triangle, an isosceles triangle, or a right triangle, a polygon including a regular polygon such as a regular pentagon or a regular hexagon, an ellipse, and the like, or may be an irregular shape.

A size of the opening member is not particularly limited and may be an appropriate size according to an application of the opening member. For example, in a case where a wavelength of a sound wave at a frequency to be absorbed is denoted by $\lambda$, an area S of the opening cross-section preferably satisfies $S<\pi(\lambda/2)^2$. This is because that at the frequency where this condition is not satisfied, a spatial mode (transverse mode) is formed in a tube line cross-sectional direction and thus a plane wave is not maintained.

Materials of the opening member of the present invention are not particularly limited, and examples of the materials include metal materials such as aluminum, titanium, magnesium, tungsten, iron, steel, chromium, chromium molybdenum, nichrome molybdenum, and alloys thereof, resin materials such as acrylic resins, polymethyl methacrylate, polycarbonate, polyamideimide, polyarylate, polyether imide, polyacetal, polyether ether ketone, polyphenylene sulfide, polysulfone, polyethylene terephthalate, polybutylene terephthalate, polyimide, and triacetyl cellulose, carbon fiber reinforced plastics (CFRP), carbon fiber, glass fiber reinforced plastics (GFRP), and wall materials such as concrete similar to the wall material of buildings and mortar.

Next, the resonance structure according to the present invention will be described.

(Resonance structure)

The resonance structures 14 (14*a* and 14*b*) shown in FIG. 1 are Helmholtz resonance structures 20 (20*a* and 20*b*) that resonates with a sound wave.

Figure 3A:
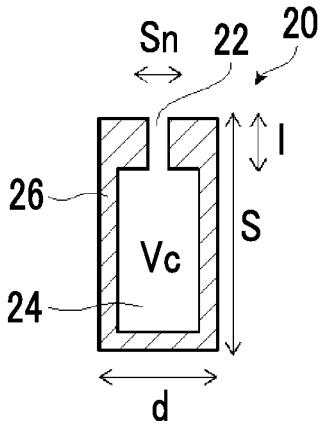
FIG. 3A is a cross-sectional view schematically showing a Helmholtz resonator used in the soundproof structure body shown in FIG. 2.

As shown in FIGS. 1, 2 and 3A, the Helmholtz resonance structures 20 (20*a* and 20*b*) include housings 26 (26*a* and 26*b*) that have resonance holes 22 (22*a* and 22*b*) communicating with the outside and hollow spaces 24 (24*a* and 24*b*) therein, respectively, and refer to Helmholtz resonators.

As shown in FIGS. 1 and 2, the resonance holes 22*a* and 22*b* of the Helmholtz resonance structures 20*a* and 20*b* each are installed to be disposed parallel along the waveguide forward direction (the traveling direction of the sound wave) in the opening tube line 12*a* of the tubular body 12.

In a case where the Helmholtz resonance structures 20 (20*a* and 20*b*), the resonance holes 22 (22*a* and 22*b*), the hollow spaces 24 (24*a* and 24*b*), and the housings 26 (26*a* and 26*b*) are required to be described separately, the Helmholtz resonance structures 20*a* and 20*b*, the resonance holes 22*a* and 22*b*, the hollow spaces 24*a* and 24*b*, and the housings 26*a* and 26*b* will be separately described, respectively. However, in a case where it is not required to be described separately, the Helmholtz resonance structure 20, the resonance hole 22, the hollow space 24, and the housing 26 will be described with no separation.

Here, the Helmholtz resonance structure 20 has the hollow space 24 that serves as the resonance space in the housing 26. The resonance hole 22 is provided to have a predetermined length on an upper portion of the housing 26, and the hollow space 24 inside the housing 26 and the outside are communicated through the resonance hole 22.

In addition, in an example shown in FIG. 1, the housing 26 has a rectangular parallelepiped shape in a plan view, and the hollow space 24 that is a resonance space also has a rectangular parallelepiped shape in a plan view. A shape of the housing 26 may be any shape as long as the hollow space 24 can be formed therein and the Helmholtz resonance structure 20 can be disposed in the opening tube line 12*a* of the tubular body 12. For example, in the present invention, a cross-sectional shape of the housing 26 is not particularly limited. The shape is, for example, a planar shape, and may be a quadrangle such as a square, a rectangle, a diamond, or a parallelogram, a triangle such as an equilateral triangle, an isosceles triangle, or a right triangle, a polygon including a regular polygon such as a regular pentagon or a regular hexagon, or a circle or an ellipse, and the like, or may be an irregular shape.

A shape of the hollow space 24 is not particularly limited and is preferably the same as the shape of the housing 26, but may be a different shape.

Materials of the housing 26 are preferably hard materials, but are not particularly limited. The materials of the housing 26 are not particularly limited as long as materials have a strength suitable in a case of being applied to the above described soundproofing targets and are resistant to a soundproof environment of the soundproofing targets, and can be selected in accordance with the soundproofing targets and the soundproof environment thereof. Examples of the materials of the housing 26 include metal materials such as aluminum, titanium, magnesium, tungsten, iron, steel, chromium, chromium molybdenum, nichrome molybdenum, and alloys thereof, resin materials such as acrylic resins, polymethyl methacrylate, polycarbonate, polyamideimide, polyarylate, polyetherimide, polyacetal, polyether ether ketone, polyphenylene sulfide, polysulfone, polyethylene terephthalate, polybutylene terephthalate, polyimide, and triacetyl cellulose, carbon fiber reinforced plastic (CFRP), carbon fiber, and glass fiber reinforced plastic (GFRP).

In addition, as the materials of the housing 26, these plural kinds of materials may be used in combination.

A conventionally known sound absorbing material may be disposed in the hollow space 24 of the housing 26.

A size of the housing 26 (in a plan view) can be defined as a size between outer surfaces of the housing 26, but is not particularly limited. The size of the housing 26 can be represented by, for example, as shown in FIG. 2 and FIG. 3A, a width d along the waveguide forward direction and an area S (height×depth) of a side surface orthogonal to the waveguide forward direction in a case where the housing 26 has a rectangular parallelepiped shape and the Helmholtz resonance structure 20 is installed parallel along the waveguide forward direction (the traveling direction of the sound wave) in the opening tube line 12*a* of the tubular body 12.

Here, the width d of the housing 26 preferably satisfies $\lambda/2 \leq d$, and more preferably $\lambda/4 \leq d$, where $\lambda$ is a wavelength corresponding to a resonance frequency of the housing 26.

The area S of the side surface of the housing 26 is preferably 1% to 99% of the opening cross-section 12*b* of the tubular body 12, and more preferably 5% to 50%.

The housing 26 forming the Helmholtz resonance structure 20 can be manufactured by bonding or fixing an upper portion of the housing having the resonance hole 22 to an upper surface of a housing main body formed of a bottomed frame forming the hollow space 24 using a fixture.

The resonance hole 22 preferably has a circular cross-section, but is not particularly limited, and a cross-sectional shape thereof may have a polygonal shape such as a square.

A cross-sectional size (cross-sectional area) Sn and an axial length 1 of the resonance hole 22 are not particularly limited, and are parameters that determine a resonance frequency of the Helmholtz resonance structure 20. Thus, the cross-sectional size Sn and the axial length 1 of the resonance hole 22 can be determined according to a resonance frequency to be required.

Here, an impedance Z of the Helmholtz resonance structure 20 is given by Expression (8) with reference to Fundamentals of Physical Acoustics, Wiley-Interscience (2000).

$$Z = \frac{\rho c k^2}{2\pi} + i\left(\frac{\rho c k lc}{S_n} - \frac{\rho c}{k V_c}\right) \tag{8}$$

$\rho$ denotes a density of air (for example, 1.205 kg/m$^2$ (room temperature))(20°) and C denotes a speed of sound (343 m/sec). k denotes a wave number ($k=2\pi/\lambda=2\pi C/f$: $\lambda$ wavelength, f: frequency). Sn denotes a cross-sectional area perpendicular to an axial direction of the resonance hole 22 (a cross-sectional area of the neck of the Helmholtz), lc denotes an axial length of the resonance hole 22 (a length of the neck of the Helmholtz), and Vc denotes a volume of the hollow space (an internal space of the Helmholtz) 24 that serves as a resonance space of the housing 26.

In addition, in a case where C denotes the speed of sound, Sn denotes the cross-sectional area perpendicular to the axial direction of the resonance hole 22, lc denotes the axial length of the resonance hole 22 (a value obtained from an opening end correction), and Vc denotes a volume of the hollow space 24 that serves as the resonance space of the housing 26, a Helmholtz resonance frequency fh is given by Expression (15).

$$fh=(C/2\pi)\cdot\{Sn/(lc\cdot Vc)\}^{1/2} \tag{15}$$

Therefore, in a case where the required Helmholtz resonance frequency fh is determined, the cross-sectional area Sn of the resonance hole 22, the length lc of the resonance hole 22, and the volume Vc of the hollow space 24 of the housing 26 may be selected appropriately to satisfy Expression (15).

As described above, in the soundproof structure body 10 shown in FIG. 1, it is preferable that the Helmholtz resonance frequencies fh in the Helmholtz resonance structures 20*a* and 20*b* which are the two resonance structures 14*a* and 14*b* are different from each other. Thus, in the Helmholtz resonance structures 20*a* and 20*b*, the Helmholtz resonance frequencies fh determined by Expression (15) may be changed by changing the cross-sectional area Sn of the resonance hole 22, the length lc of the resonance hole 22, and the volume Vc of the hollow space 24 of the housing 26.

The soundproof structure body 10 shown in FIG. 1 uses the Helmholtz resonance structure 20 (20*a* and 20*b*) as the resonance structure 14 (14*a* and 14*b*), but the present invention is not limited thereto, and any resonance structures may be used. For example, a film resonance structure 30 shown in FIG. 3B may be used as the resonance structure 14 instead of the Helmholtz resonance structure 20, and an air column resonance structure 40 shown in FIG. 3C may be used. In a case of using a plurality of resonance structures 14, more than one of each of a Helmholtz resonance structure 20 shown in FIG. 3A, a film resonance structure 30 shown in FIG. 3B, and an air column resonance structure 40 shown in FIG. 3C may be used alone, and may be used in combination.

Figure 3B:
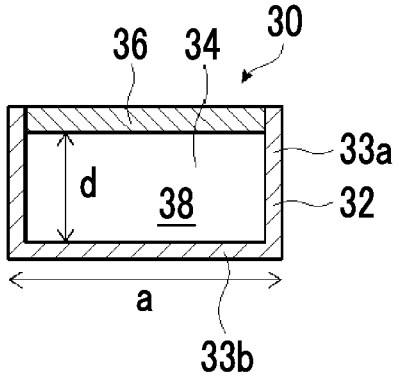
FIG. 3B is a cross-sectional view schematically showing an example of a film resonance structure used in a soundproof structure body according to another embodiment of the present invention.

The film resonance structure 30 shown in FIG. 3B includes a frame 32 and a film 36 fixed to one end of the frame 32 to cover an opening of a hole portion 34 of the frame 32, and a back space 38 of the film 36 is formed with the frame 32 and the film 36.

In the soundproof structure body 10 according to the embodiment of the present invention, the plurality of film resonance structures 30 are installed respectively so that the films 36 thereof are disposed parallel along the waveguide forward direction (the traveling direction of the sound wave) in the opening tube line 12*a* of the tubular body 12.

The frame 32 is a bottomed frame formed with a surrounding portion 33*a* surrounding the hole portion 34 and a bottom portion 33*b* facing one opening of the hole portion 34.

The frame 32 is used for fixing and supporting the film 36 to cover the hole portion 34, and serves as a node of film vibration of the film 36 fixed to the frame 32. Therefore, the frame 32 has higher stiffness than the film 36, and specifically, both the high mass and the high stiffness per unit area are preferable.

The frame 32 shown in FIG. 3B is a bottomed frame that includes a bottom portion 33*b* and that is provided with a hole portion 34 having an opening of which only one side is opened, but the present invention is not limited thereto, and the frame 32 may be a frame that includes only the surrounding portion 33*a* provided with the hole portion 34 having an opening of which both sides are opened. In a case of the frame including only the surrounding portion 33*a*, the other opening may have the same film as the film 36, or may have a back plate made of the same material as the frame material.

It is preferable that the frame 32 has a blocked continuous shape capable of fixing the film 36 to restrain the entire periphery of the film 36, but the present invention is not limited thereto. In addition, the frame 32 may be made to have a discontinuous shape by cutting a part thereof as long as the frame 32 serves as a node of film vibration of the film 36 fixed to the frame 32. That is, since the role of the frame 32 is to fix and support the film 36 to control the film vibration, the effect is achieved even though there are small cuts in the frame 32 or even though there are unbonded parts.

The shape of the hole portion 34 of the frame 32 is preferably a planar shape and a square, but in the present invention, the shape of the hole portion 34 is not particularly limited. For example, the shape of the hole portion 34 may be a quadrangle such as a rectangle, a diamond, or a parallelogram, a triangle such as an equilateral triangle, an isosceles triangle, or a right triangle, a polygon including a regular polygon such as a regular pentagon or a regular hexagon, or a circle or an ellipse, and the like, or may be an irregular shape. End portions of the hole portion 34 of the frame 32 are not blocked but opened to the outside as they are. The film 36 is fixed to the frame 32 to cover the hole portion 34 in the opened end portions of the hole portion 34.

Although the end portions of the hole portion 34 of the frame 32 are not blocked but opened to the outside as they are in FIG. 3B, both end portions of the hole portion 34 are opened to the outside and one end portion may be blocked by a member such as the back plate.

A size a of the frame 32 is a size in a plan view, and can be defined as a size obtained by adding widths of both sides of the frame 32 to the size of the hole portion 34. However, since the widths of both sides of the frame 32 are small, the size a can also be the size of the hole portion 34. In a case where the shape of the frame 32 is a circle or a regular polygonal shape such as a square, the size a of the frame 32 can be defined as a distance between opposite sides passing through a center thereof or as a circle equivalent diameter, and in a case of a polygon, an ellipse, or an irregular shape, the size of the frame 32 can be defined as a circle equivalent diameter. In the present invention, a circle equivalent diameter and a radius are a diameter and a radius in terms of circles having the same area, respectively.

The size a of the frame 32 is not particularly limited, and may be set according to the above described soundproofing target to which the soundproof structure body 10 according to the embodiment of the present invention is applied for soundproofing.

For example, the size a of the frame 32 is not particularly limited, and for example, the size a of the frame 32 is preferably 0.5 mm to 300 mm, more preferably 1 mm to 100 mm, and most preferably 10 mm to 50 mm.

Here, a thickness of the frame 32 can be referred to as a thickness of the surrounding portion 33*a* and can be defined as a depth d of the hole portion 34 of the frame 32. Therefore, in the following, the depth d of the hole portion 34 will be used.

The thickness d of the frame 32, that is, the depth d of the hole portion 34 is not particularly limited. In addition, since the depth d affects the resonance frequency of vibration of the film 36, the depth d may be set according to a resonance frequency, and for example, may be set according to the size of the hole portion 34.

The depth d of the hole portion 34 is preferably 0.5 mm to 200 mm, more preferably 0.7 mm to 100 mm, and most preferably 1 mm to 50 mm.

The width of the frame 32 can be referred to as the thickness of the member forming the frame 32, but the width of the frame 32 is not particularly limited as long as the film 36 can be fixed and the film 36 can be reliably supported. The width of the frame 32 can be set, for example, according to the size a of the frame 32. Here, the thickness of the bottom portion 33*b* of the frame 32 can be defined similarly to the width of the frame 32.

For example, in a case where the size a of the frame 32 is 0.5 mm to 50 mm, the width of the frame 32 is preferably 0.5 mm to 20 mm, more preferably 0.7 mm to 10 mm, and most preferably 1 mm to 5 mm.

In addition, in a case where the size a of the frame 32 is more than 50 mm and 300 mm or less, the width of the frame 32 is preferably 1 mm to 100 mm, more preferably 3 mm to 50 mm, and most preferably 5 mm to 20 mm.

In a case where a ratio of the width of the frame 32 to the size a of the frame 32 is too large, an area ratio of the frame 32 portion occupying the entire area increases, and there is concern that weight of the device (the resonance structure 14) increases. On the other hand, in a case where the ratio is too small, it is difficult to strongly fix the film 36 at the frame 32 portion with an adhesive or the like.

Materials of the frame 32 are not particularly limited as long as materials can support the film 36, have a strength suitable in a case of being applied to the above described soundproofing targets, and are resistant to a soundproof environment of the soundproofing targets, and the materials can be selected in accordance with the soundproofing targets and the soundproof environment thereof. For example, as the materials of the frame 32, the same materials as the materials of the housing 26 can be used.

In addition, as the materials of the frame 32, these plural kinds of materials may be used in combination.

A conventionally known sound absorbing material may be disposed in the hole portion 34 of the frame 32.

The sound absorbing material is disposed, whereby sound insulating properties can be further improved by the sound absorbing effect of the sound absorbing material. In addition, the sound absorbing material is not particularly limited, and various known sound absorbing materials such as a urethane plate and a nonwoven fabric can be used. The same applies in a case where the sound absorbing material is disposed in the hollow space 24 of the housing 26.

As described above, a known sound absorbing material is used in combination within the resonance structure 14 (the Helmholtz resonance structure 20 or the film resonance structure 30) of the present invention or together with the resonance structure 14, whereby both the sound absorbing effect of the resonance structure 14 of the present invention and the sound absorbing effect of the known sound absorbing material can be obtained.

The film 36 covers the hole portion 34 inside the frame 32 and is fixed to the frame 32 to be restrained. Furthermore, the film 36 absorbs energy of sound waves or reflects sound waves by vibrating in response to sound waves from the outside to insulate sound. That is, it can be said that a film resonance body is formed with the frame 32 and the film 36.

Since the film 36 needs to vibrate with the frame 32 as a node, it is necessary that the film 36 is fixed to the frame 32 to be reliably restrained and absorbs or reflects the energy of sound waves to insulate sound. Thus, it is preferable that the film 36 is formed of a flexible elastic material.

Therefore, the film 36 has an exterior shape in which the width of the frame 32 (width of the surrounding portion 33*a*) of the outer side of the hole portion 34 is added to the shape of the hole portion 34 of the frame 32.

In addition, since the film 36 needs to be reliably fixed to the frame 32 and to function as a vibrating film, it is necessary that a size (of the exterior shape) of the film 36 is larger than the size of the hole portion 34. The size (of the exterior shape) of the film 36 may be larger than the size a of the frame 32, which is obtained by adding the widths of the surrounding portion 33*a* of the frame 32 on both sides of the hole portion 34 to the size of the hole portion 34, but this larger portion does not have a function as a vibrating film and does not have a function of fixing the film 36. Thus, the size of the film 36 is preferably equal to or smaller than the size a of the frame 32.

In addition, the thickness of the film 36 is not particularly limited as long as the film can vibrate by absorbing the energy of sound waves to insulate sound, but it is preferable to make the film 36 thick in order to obtain a vibration mode with the largest oscillation on a high frequency side, and thin in order to obtain the vibration mode on a low frequency side. For example, in the present invention, the thickness of the film 36 shown in FIG. 3A can be set in accordance with the size a of the frame 32 or the size of the hole portion 34, that is, the size of the film 36.

For example, in a case where the size L of the hole portion 34 is 0.5 mm to 50 mm, the thickness of the film 36 is preferably 0.001 mm (1 μm) to 5 mm, more preferably 0.005 mm (5 μm) to 2 mm, and most preferably 0.01 mm (10 μm) to 1 mm.

In addition, in a case where the size L of the hole portion 34 is more than 50 mm and 300 mm or less, the thickness of the film 36 is preferably 0.01 mm (10 μm) to 20 mm, more preferably 0.02 mm (20 μm) to 10 mm, and most preferably 0.05 mm (50 μm) to 5 mm.

The thickness of the film 36 is preferably represented by an average thickness in a case where one film 36 has various thicknesses.

Here, an impedance Z of the film resonance structure 30 is given by Expression (9) with reference to J. Sound Vib. (1969)10(3), 411-423, and Proceedings of the 22th international congress on Sound and Vibration (Florence, Italy 12-16 Jul. 2015), LOW-FREQUENCY SOUND ABSORPTION USING A FLEXIBLE THIN METAL PLATE AND A LAYER OF POLYURETHANE FOAM (1258).

$$Z = \frac{B_i D g}{a^4 \omega} + i\left(\rho_S \omega A_i - \frac{B_i D}{a^4 \omega} - \cot(kd)\right) \tag{9}$$

Here, D is a bending stiffness of the film 36 and is given by Expression (10).

$$D = \frac{Eh^3}{12(1-\sigma^2)} \tag{10}$$

Here, ω denotes an angular frequency, a denotes a length of one side of the frame 32, Ai and Bi (i=1, 2, . . . ) denote impedance constants of the square-shaped film 36, E denotes a Young's modulus of the film 36, σ denotes Poisson's ratio of the film 36, h denotes a thickness of the film 36, g denotes a damping constant, and $\rho_s$ denotes an areal density of the film 36.

Here, in a case of the square-shaped film, Ai and Bi have been determined, and the following values can be used from the literature.

$$Ai=2.02,\ Bi=2.64\times10^3$$

The damping constant is determined empirically, and for example, a value of g=0.04 can be used. In addition, d is a length of a back air layer.

The film 36 fixed to the frame 32 of the film resonance structure 30 that is the resonance structure 14 of the present invention has the lowest-order resonance frequency (a first resonance frequency) which is a frequency of the lowest-order (first-order) vibration mode that can be induced in the structure of the resonance structure 14.

In addition, in the resonance structure 14 which is the film resonance structure 30 including the frame 32 and the film 36, that is, with respect to the film 36 fixed to the frame 32 to be restrained, the resonance frequency in a case where the sound wave is incident in parallel to the film surface is a frequency at which sound is drawn to the resonance structure side at the frequency at which the sound wave most disturbs film vibration, and the largest absorption peak appears (that is, a maximum absorbance is obtained). Furthermore, the lowest-order resonance frequency is the first resonance frequency which is determined by the film resonance structure 30 including the frame 32 and the film 36 and at which the vibration mode having the lowest-order film vibration is exhibited.

The lowest-order resonance frequency of the film 36 fixed to the frame 32 (for example, a boundary between a frequency region complying with the stiffness law and a frequency region complying with the mass law is the lowest-order first resonance frequency) is preferably 10 Hz to 100000 Hz corresponding to the sound wave sensing range of a human being, more preferably 20 Hz to 20000 Hz that is an audible range of sound waves of a human being, even more preferably 40 Hz to 16000 Hz, and most preferably 100 Hz to 12000 Hz.

Here, in the film resonance structure 30 that is the resonance structure 14 of the present invention, the resonance frequency of the film 36 in the structure including the frame 32 and the film 36, for example, the lowest-order resonance frequency can be determined by the geometric form of the frame 32 of the resonance structure 14, for example, the shape and size of the frame 32, and the stiffness of the film 36 of the resonance structure 14, for example, the thickness and flexibility of the film 36 and the volume of the back space 38 of the film 36.

For example, as a parameter characterizing the vibration mode of the film 36, in a case of the film 36 formed of the same material, a ratio of the size (L) squared of the hole portion 34 to the thickness (t) of the film 36, for example, in a case of a square, a ratio $[L^2/t]$ to the size of one side can be used, and in a case of the ratio $[L^2/t]$ is equal, the vibration mode has the same frequency, that is, the same resonance frequency. That is, by setting the ratio $[L^2/t]$ to a certain value, the scale law is established, and thus an appropriate size can be selected.

The Young's modulus of the film 36 is not particularly limited as long as the film 36 has elasticity capable of performing film vibration in order to insulate sound by absorbing or reflecting the energy of sound waves, and it is preferable that the Young's modulus of the film 36 is large in order to obtain the vibration mode of the film 36 on the high frequency side and is small in order to obtain the vibration mode on the low frequency side. For example, the Young's modulus of the film 36 can be set according to the size of the frame 32 (the hole portion 34), that is, the size of the film in the present invention.

For example, the Young's modulus of the film 36 is preferably 1000 Pa to 3000 GPa, more preferably 10000 Pa to 2000 GPa, and most preferably 1 MPa to 1000 GPa.

The density of the film 36 is not particularly limited as long as the film 36 can perform the film vibration by absorbing or reflecting the energy of sound waves to insulate sound, and for example, the density of the film 36 is preferably 5 $kg/m^3$ to 30000 $kg/m^3$, more preferably 10 $kg/m^3$ to 20000 $kg/m^3$, and most preferably 100 $kg/m^3$ to 10000 $kg/m^3$.

In a case where a film-shaped material or a foil-shaped material is used as a material of the film 36, the material of the film 36 is not particularly limited as long as the material has a strength in a case of being applied to the above soundproofing target and is resistant to the soundproof environment of the soundproofing target, and the film 36 can perform the film vibration by absorbing or reflecting the energy of sound waves to insulate sound. The material can be selected according to the soundproofing target, the soundproof environment, and the like. Examples of the material of the film 36 include resin materials that can be made into a film shape such as polyethylene terephthalate (PET), polyimide, polymethylmethacrylate, polycarbonate, acrylic (PMMA), polyamideimide, polyarylate, polyetherimide, polyacetal, polyetheretherketone, polyphenylene sulfide, polysulfone, polybutylene terephthalate, triacetyl cellulose, polyvinylidene chloride, low density polyethylene, high density polyethylene, aromatic polyamide, silicone resin, ethylene ethyl acrylate, vinyl acetate copolymer, polyethylene, chlorinated polyethylene, polyvinyl chloride, polymethyl pentene, and polybutene, metal materials that can be made into a foil shape such as aluminum, chromium, titanium, stainless steel, nickel, tin, niobium, tantalum, molybdenum, zirconium, gold, silver, platinum, palladium, iron, copper, and permalloy, fibrous materials such as paper and cellulose, and materials or structures capable of forming a thin structure such as a nonwoven fabric, a film containing nano-sized fiber, porous materials including thinly processed urethane or synthrate, and carbon materials processed into a thin film structure.

In addition, the film 36 is fixed to the frame 32 to cover an opening of the hole portion 34 of the frame 32.

The method of fixing the film 36 to the frame 32 is not particularly limited, and any methods may be used as long as the film 36 can be fixed to the frame 32 to serve as a node of film vibration. Examples thereof include a method using an adhesive, a method using a physical fixture, and the like.

In the method of using an adhesive, an adhesive is applied onto a surface of the frame 32 surrounding the hole portion 34 and the film 36 is placed thereon, so that the film 36 is fixed to the frame 32 with the adhesive. Examples of the adhesive include epoxy-based adhesives (Araldite (registered trademark) (manufactured by Nichiban Co., Ltd.) and the like), cyanoacrylate-based adhesives (Aron Alpha (registered trademark) (manufactured by Toagosei Co., Ltd.) and the like), acrylic-based adhesives, and the like.

Examples of the method using a physical fixture include a method in which the film 36 disposed to cover the hole portion 34 of the frame 32 is interposed between the frame 32 and a fixing member such as a rod, and the fixing member is fixed to the frame 32 by using a fixture such as a screw, and the like.

Although the film resonance structure 30 includes the frame 32 and the film 36 as separate bodies and has the structure in which the film 36 is fixed to the frame 32, the present invention is not limited thereto, and the film resonance structure 30 may have a structure in which the film 36 and the frame 32, which are formed of the same material, are integrated.

Figure 3C:
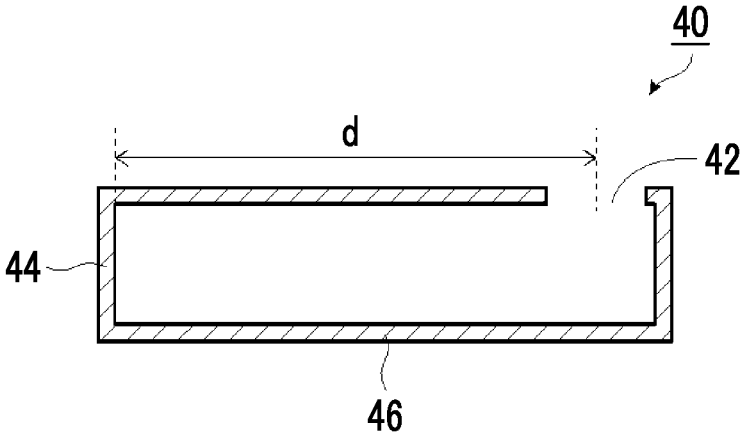
FIG. 3C is a cross-sectional view schematically showing an example of an air column resonance structure used in a soundproof structure body according to the other embodiment of the present invention.

The air column resonance structure 40 shown in FIG. 3C can also be used as the resonance structure 14 of the present invention.

The air column resonance structure 40 is an air column resonance tube formed with a tubular body 46 having an opening 42 opened to the outside on one end side and having a blocked bottom surface 44 on the other end side.

The air column resonance structure used for the soundproof structure body according to the embodiment of the present invention may be a tubular body having one end that is opened and the other end that is blocked, for example, a blocked tube, or may be a tubular body having both ends that are opened, for example, an opened tube. As described above, the air column resonance structure can be formed with the air column resonance tube including the blocked tube or the opened tube.

The structure of the tubular body 46 of the air column resonance tube 40 as described above can be configured similarly to the frame 32 of the film resonance structure 30 although the length and the shape are different, and the same material can be used.

Figure 4A:
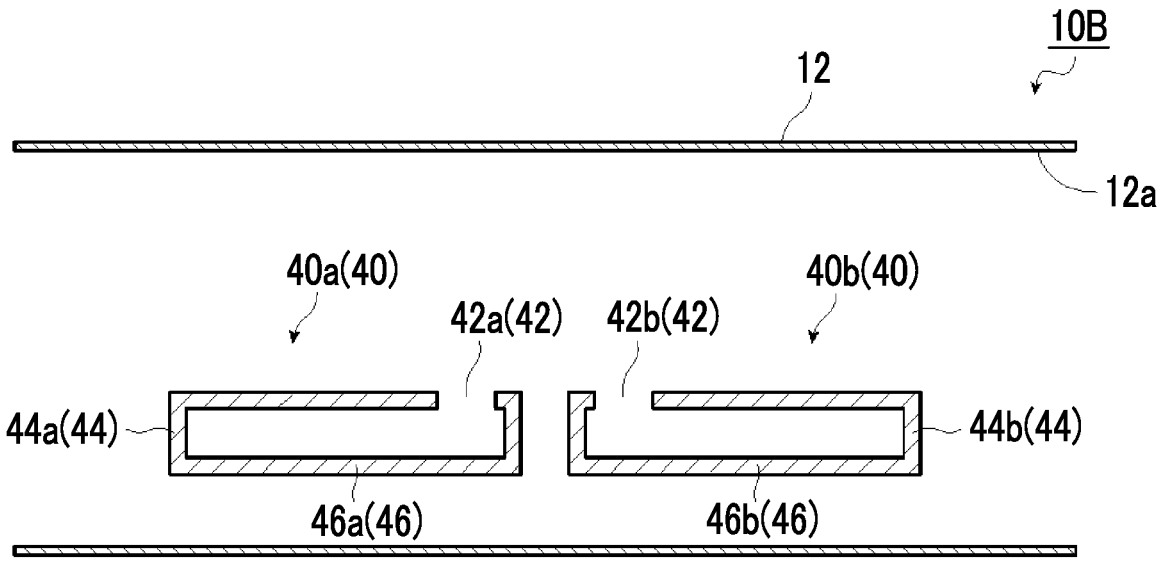
FIG. 4A is a cross-sectional view schematically showing an example of a soundproof structure body according to the other embodiment of the present invention, the air column resonance structure shown in FIG. 3C being used in the soundproof structure body.
Figure 4B:
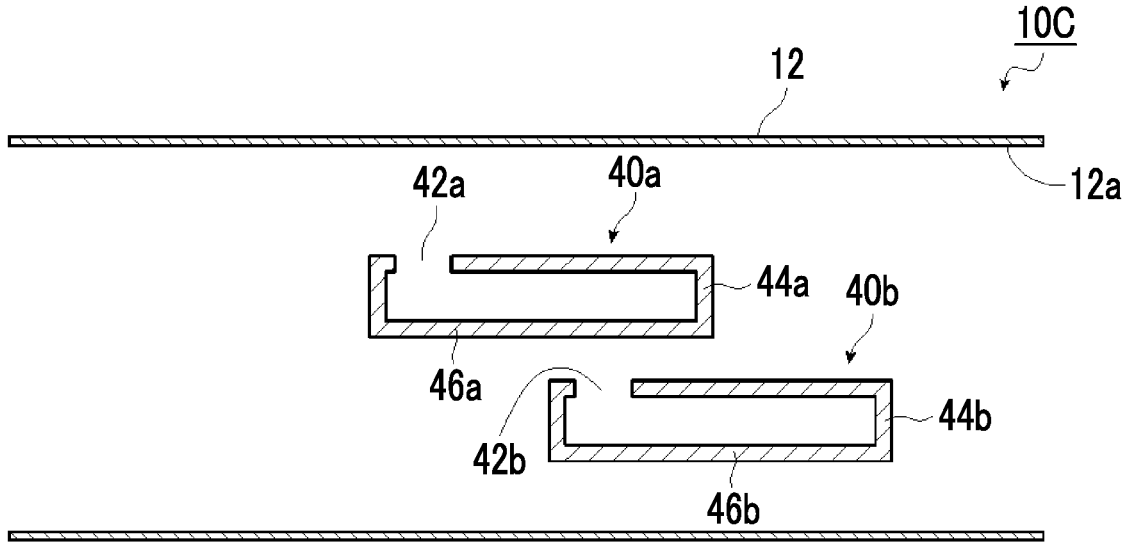
FIG. 4B is a cross-sectional view schematically showing another example of a soundproof structure body according to the other embodiment of the present invention, the air column resonance structure shown in FIG. 3C being used in the soundproof structure body.

In the soundproof structure body 10B shown in FIG. 4A, the two air column resonance tubes 40 (40*a* and 40*b*) are installed respectively so that the openings 42 (42*a* and 42*b*) are adjacent to each other in the same line along the waveguide forward direction (the traveling direction of the sound wave) in the opening tube line 12*a* of the tubular body 12. On the other hand, in the soundproof structure body 10C shown in FIG. 4B, the two air column resonance tubes 40 (40*a* and 40*b*) are installed respectively so that the openings 42 (42*a* and 42*b*) are disposed in parallel to be vertically adjacent to each other along the waveguide forward direction (the traveling direction of the sound wave) in the opening tube line 12*a* of the tubular body 12. That is, in the soundproof structure body according to the embodiment of the present invention, the plurality of air column resonance structures 40 are installed respectively so that the openings 42 are disposed in parallel to be adjacent to each other along the waveguide forward direction (the traveling direction of the sound wave) in the opening tube line 12*a* of the tubular body 12.

The length d of the tubular body 46 (the air column resonance tube) is defined as a distance between the center of the plane of the opening 42 of the tubular body 46 and the bottom surface 44 of the tubular body 46, as shown in FIG. 3C.

Here, an impedance Z of the air column resonance structure is given by Expression (11) with reference to p308 of ARCHITECTURAL ACCOUSTICS, SECOND EDITION, ACADEMIC PRESS (2014).

$$Z = \rho_0 C\left(\frac{1}{2}(ka)^2 + \frac{2i}{\pi ka}\right) - i\rho_0 C\cot(qd) \tag{11}$$

Here, q denotes a propagation constant and is given by Expression (12).

$$q = k\left(1 + \frac{0.31i}{2a\sqrt{f}}\right) \tag{12}$$

Here, k denotes a wave number ($k=2\pi/\lambda=2\pi C/f$: $\lambda$ wavelength), f denotes a frequency, a denotes a radius of an air column resonance tube, $\rho 0$ denotes a density of air, C denotes a speed of sound, and d denotes a length of a tube.

Here, a frequency at which the imaginary part of Expression (11) is 0 is the resonance frequency.

The soundproof structure body 10 according to the embodiment of the present invention and the resonance structure 14 used therein are basically formed as described above.

Hereinbelow, the theory that is a soundproof principle of the soundproof structure body 10 according to the embodiment of the present invention will be explained.

First, the absorbance may increase or decrease depending on an installation interval of the resonance structure 14 in the opening tube line 12*a* of the opening member (the tubular body 12).

Figure 5:
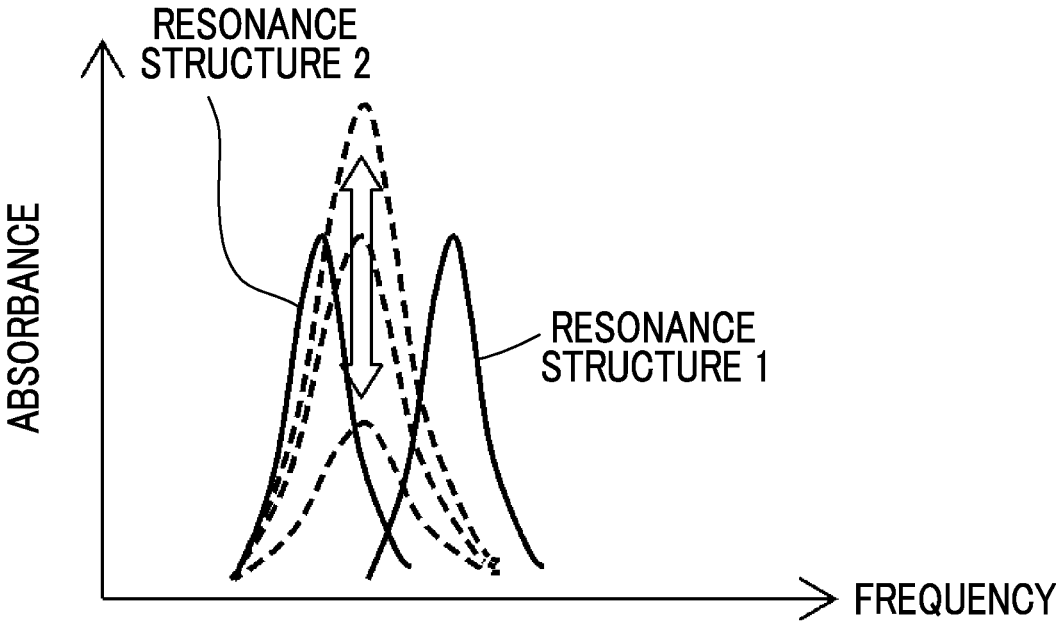
FIG. 5 is a graph showing changes in absorbance in a case where two resonance structures are installed in a duct.

For example, absorbances of the two resonance structures 14 in a case where the two resonance structures 14 each are installed independently are shown as solid lines in FIG. 5, and synthetic absorbances in a case where the two resonance structures 14 are installed at different intervals are shown as dotted lines in FIG. 5.

As shown in FIG. 5, in a case where the two resonance structures 14 are installed, there are cases in which high absorption can be exhibited or cannot be exhibited (that is, the absorption is lower than a case in which one resonance structure 14 is placed) depending on a placement method of the two resonance structures 14 or resonance frequencies of the two resonance structures 14.

Figure 6:
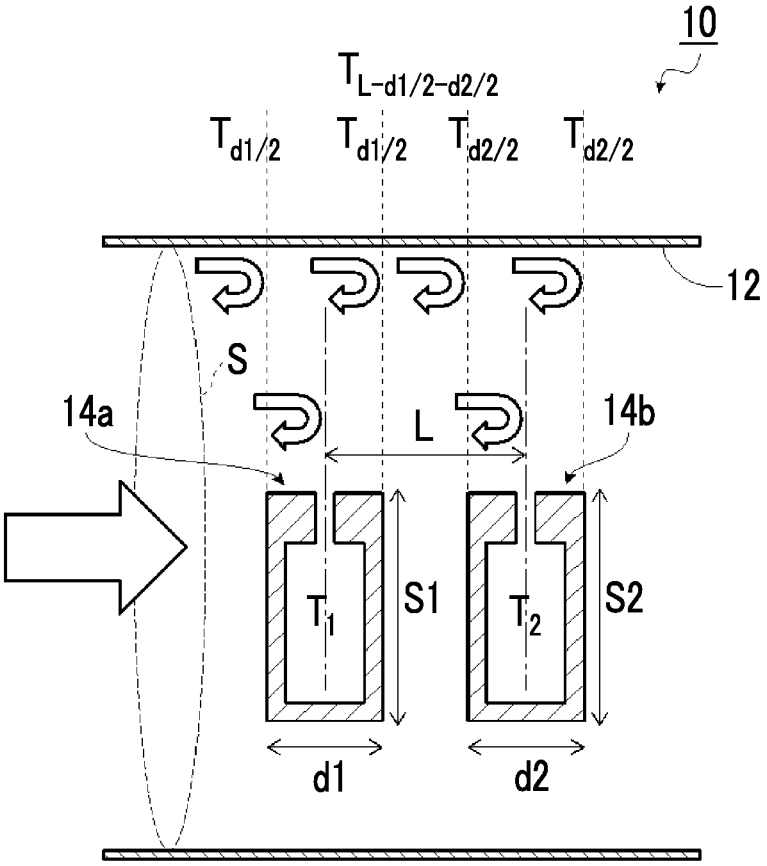
FIG. 6 is an illustration diagram illustrating a transfer matrix corresponding to two resonance structures and a transfer matrix corresponding to a distance in the soundproof structure body shown in FIG. 1.

As shown in FIG. 6, this is because there are reflected waves which are reflected from a first resonance structure 14*a* and a second resonance structure 14*b*, respectively (two reflected waves on the lower side in FIG. 6), and reflected waves which are reflected from the interface where the cross-sectional area is discontinuous (four reflected waves on the upper side in FIG. 6). In a case where the reflected waves intensify each other, the reflection increases, and the absorbance thereof decreases accordingly.

In order to obtain high absorption, it is necessary to design reflectance and transmittance to be low at the same time.

In order to realize the above description, it is necessary to consider a theory based on a concept of a transfer matrix including an impedance and interval of each resonator.

The structure of the invention based on the theory will be described below.

In the soundproof structure body 10 according to the embodiment of the present invention, in a case where as shown in FIG. 2, a cross-sectional area of the tubular body 12 is defined as S, cross-sectional areas of the plurality of resonance structures 14 are defined as Si, widths thereof are defined as di, intervals of two resonance structures 14 adjacent to each other are defined as L, an impedance thereof is defined as Zi, and a synthetic acoustic impedance of two resonance structures 14 adjacent to each other is defined as Zc, a condition of Expression (1) is satisfied at a resonance frequency f0 at which a theoretical absorption value At given by Expression (2) is a maximum value.

$$At(f0, L, S, Si, di, Zi) > 0.75 \tag{1}$$

Here, L>0, S>0, Si>0, di>0, and i=1, 2

$$At(f, L, S, Si, di, Zi) = 1 - |(Zc(f, L, S, Si, di, Zi) - Z0)/(Zc(f, L, S, Si, di, Zi) + Z0)|^2 - |2/(Ac(f, L, S, Si, di, Zi) + Bc(f, L, S, Si, di, Zi)/Z0 + Z0Cc(f, L, S, Si, di, Zi) + Dc(f, L, S, Si, di, Zi))|^2 \tag{2}$$

Here, in a case where "f, L, S, Si, di, Zi (i=1, 2)" is represented by x, Expression (2) can be represented as $At(x)=1-|(Zc(x)-Z0)/(Zc(x)+Z0)|^2-|2/(Ac(x)+Bc(x)/Z0+Z0Cc(x)+Dc(x))|^2$.

The cross-sectional area S is an area of the opening cross-section 12*b* of the tubular body 12.

The resonance structure 14 includes the Helmholtz resonance structure 20, the film resonance structure 30, and an air column resonance structure.

The cross-sectional area Si in the plurality of resonance structures 14 is a cross-sectional area in the opening tube line 12*a* in the waveguide forward direction of the resonance structure 14, and is an area on a side surface of the resonance structure 14 perpendicular to the waveguide forward direction (the traveling direction of the sound wave). i is represented by 1, 2, . . . , and indicates an order from an upstream side of the plurality of resonance structures 14, that is, a side closer to a sound source.

The width di in the plurality of resonance structures 14 is a length in the opening tube line 12*a* along the waveguide forward direction of the resonance structure 14, and is a length of a side surface of the resonance structure 14 in parallel to the waveguide forward direction (the traveling direction of the sound wave).

The plurality of resonance structures 14 include two resonance structures 14 adjacent to each other, and the interval L between the two resonance structures 14 is a distance along the waveguide forward direction (in parallel to the traveling direction of the sound wave) between centers of resonant portions of the two resonance structures 14. For example, in a case where the two resonance structures 14 are the Helmholtz resonance structures 20, the interval L is a distance between centers of the resonance holes 22. In addition, in a case where the two resonance structures 14 are the film resonance structures 30, the interval L is a distance between centers of the films 36. In addition, in a case where the two resonance structures 14 are the air column resonance structures, the interval L is a distance between centers of the opened end of the air column resonance tube.

The synthetic acoustic impedance Zc is obtained in consideration of the two resonance structures 14 adjacent to each other and the interval L therebetween, a change in the cross-sectional area of the waveguide, and the two resonance structures 14 adjacent to each other.

Here, the theoretical absorption value At (f0, L, S, Si, di, Zi) at the resonance frequency f0 will be considered. First, in a case where there is only one resonance structure, the transfer matrix can be described by Expression (16).

$$T_1 = \begin{pmatrix} 1 & 0 \\ \frac{1}{Z_1} & 1 \end{pmatrix} \tag{16}$$

Here, $Z_1$ denotes an impedance of the resonance structure. In this case, in a case where Zc is described based on Expression (17), $$Zc=Z0Z1/(Z0+Z1) \tag{17}$$

In a case where a reflection coefficient rc and a transmission coefficient tc are described based on Expression (18) described later, the reflection coefficient rc and the transmission coefficient tc can be represented as follows.

$$\begin{aligned} rc &= (Zc - Z0)/(Zc + Z0) \\ &= Z0/(2Z1 + Z0) \\ tc &= 2Z1/(Z0 + 2Z1) \end{aligned}$$

Therefore, the absorbance is represented by $$\begin{aligned} A &= 1 - |rc|^2 - |rc| \\ &= 1 - Z0/(2Z1 + Z0)|^2 - |2Z1/(Z0 + 2Z1)|^2 \\ &= 4Z0Z1/(Z0 + 2Z1)^2. \end{aligned}$$

In this case, since Z0 is an impedance (constant) of the tube line, an absorption value is determined depending on the value of Z1. From the above expression, in a case of Z1=Z0/2, it is theoretically represented from the above described derivation expression that a maximum value of 0.5 is taken, and a value more than the maximum value of 0.5 does not exist. That is, it can be seen that in a case where the number of resonance structures is one, the maximum absorbance is 50%.

Here, in a case where two structures are installed, it is assumed that one structure absorbs up to 50% of the sound and transmits the remaining 50%, and assumed that the second resonance structure absorbs the maximum absorbance of 50%, $$A=1-(0.5\times(1-0.5))=0.75.$$

That is, it can be seen that a simple theoretical absorption limit value As in a case of being calculated simply without considering the wave nature is 75% at the maximum. However, the theoretical absorption value At, in which the absorbance is derived from the synthetic acoustic impedance obtained by considering the two resonance structures and the distance therebetween, is characterized by being able to obtain the absorbance more than 75% which is the maximum value of the simple theoretical absorption limit value As obtained herein.

The synthetic acoustic impedance Zc (x) of Expression (2) is defined by Expression (3).

$$Zc(x) = \frac{Z_0 A_C(x) + B_C(x)}{Z_0 C_C(x) + D_C(x)}, \tag{3}$$

In addition, Z0 of Expression (2) is an acoustic impedance of an opening tube line represented by Zair/S(=Z0) (S is a tube line cross-sectional area).

Zair denotes an acoustic impedance of air and is given by Zair=ρC.

ρ denotes a density of air (for example, 1.205 kg/m$^2$ (room temperature)) (20°) and C denotes a speed of sound (343 m/sec (room temperature)) (20°).

In addition, Ac(x), Bc(x), Cc(x), and Dc(x) in the above Expressions (2) and (3) are elements of a transfer matrix, and are defined by Expression (4).

$$\begin{aligned} T_C &= T_{d1/2} T_1 T_{d1/2} T_{L-d1/2-d2/2} T_{d2/2} T_2 T_{d2/2} \\ &= \begin{pmatrix} A_C(x) & B_C(x) \\ C_C(x) & D_C(x) \end{pmatrix} \end{aligned} \tag{4}$$

In Expression (4), Tc is a transfer matrix of the two resonance structures 14.

In addition, $T_i$ (i=1, 2) is a transfer matrix corresponding to a resonance structure in each of the two resonance structures 14, and is defined by Expression (5).

$$T_i = \begin{pmatrix} 1 & 0 \\ \frac{1}{Z_1} & 1 \end{pmatrix} \tag{5}$$

In addition, $T_{di/2}$ is a transfer matrix corresponding to a distance of the resonance structure 14 in each of the two resonance structures 14, and is defined by Expression (6).

Here, Zi is an impedance Z of the resonance structure 14, and in a case where the resonance structure 14 is the Helmholtz resonance structure 20, Zi is given by Expression (8), in a case of the film resonance structure 30, Zi is given by Expression (9), and in a case of the air column resonance structure, Zi is given by Expression (11).

$$T_{di/2} = \begin{pmatrix} \cos k\frac{d}{2} & i\frac{Z_{air}}{s - s_i}\sin k\frac{d}{2} \\ i\frac{s - s_i}{Z_{air}}\sin k\frac{d}{2} & \cos k\frac{d}{2} \end{pmatrix} \tag{6}$$

$$(i = 1, 2)$$

$T_{L-d1/2-d2/2}$ is a transfer matrix corresponding to the distance between the two resonance structures 14 and is defined by Expression (7).

$$T_{L-d1/2-d2/2} = \begin{pmatrix} \cos k\left(L - \frac{d_1}{2} - \frac{d_2}{2}\right) & i\frac{Z_{air}}{s}\sin k\left(L - \frac{d_1}{2} - \frac{d_2}{2}\right) \\ i\frac{s}{Z_{air}}\sin k\left(L - \frac{d_1}{2} - \frac{d_2}{2}\right) & \cos k\left(L - \frac{d_1}{2} - \frac{d_2}{2}\right) \end{pmatrix} \quad (7)$$

Here, k denotes a wave number and is given by $k=2\pi/\lambda=2\pi C/f$. Here, $\lambda$ is a wavelength and f is a frequency.

By substituting Expressions (5) to (7) into Expression (4), the expression of functions Ac(x), Bc(x), Cc(x), and Dc(x) can be obtained from Expression (4).

By substituting the expressions Ac(x), Bc(x), Cc(x), and Dc(x) obtained as described above into Expression (3), the expression of the synthetic acoustic impedance Zc (x) can be obtained.

In addition, By substituting the expression of the synthetic acoustic impedance Zc (x) obtained as described above and the expressions of Ac(x), Bc(x), Cc(x), and Dc(x) obtained as described above into Expression (2), a theoretical absorption value At(x) (=At(f, L, S, Si, di,Zi)) can be obtained.

From the expression of the theoretical absorption value At(f, L, S, Si, di,Zi) represented in Expression (2) obtained as described above, an interval L, a cross-sectional area S, a cross-sectional area Si (i=1,2), and a width di (i=1, 2) are determined and a frequency f and Zi (i=1, 2) are changed, whereby the theoretical absorption value At (f, L, S, Si, di, Zi) can be obtained as the maximum value and the frequency in this case can be obtained as fa Furthermore, the theory that is a soundproof principle of the soundproof structure body 10 according to the embodiment of the present invention will be explained.

For example, a transfer matrix Tc, a reflection coefficient rc for the impedance Zc, and a transmission coefficient tc are represented by the following Expressions (13) and (14), respectively.

$$r_C(x) = \frac{Z_c(x) - Z_0(x)}{Z_c(x) + Z_0(x)} \quad (13)$$

$$t_C(x) = \frac{2}{A_c(x) + \frac{B_c(x)}{Z_0} + C_c(x)Z_0 + D_c(x)} \quad (14)$$

Here, a reflectance R, a transmittance T, and an absorbance A can be represented as follows.

Reflectance $R=|rc|^2$

Transmittance $T=|tc|^2$

Absorbance $A=1-R-T$ (18)

Here, in order to increase the absorption, it is necessary to reduce $|rc|^2$ and $|tc|^2$.

By substituting Expression (3) of the synthetic acoustic impedance Zc as described above into Expression (18), At (theoretical absorption value) of Expression (2) can be obtained. Here, At can be derived as an analytical solution of x that is thus f, L, S, Si, di, and Zi (i is the number of the resonator).

That is, the At (theoretical absorption value) expression of Expression (2) is an absorption expression in which the impedance of the resonance structure 14 and the reflection due to area discontinuity of the waveguide cross-section, which is caused from the cross-section of the resonance structure 14, are also considered, and designing respective values of f, L, S, Si, di, and Zi to increase the value is synonymous with obtaining high absorption.

The absorbance is theoretically not more than 50% in a single structure. In a case where two structures that absorb 50% are placed and the wave nature of sound waves is ignored and then simply calculated, the absorbance is 75% in a case where the structures are disposed in series.

In the soundproof structure body according to the embodiment of the present invention, a parameter for exhibiting high absorption more than this value is specified. In a case where the theoretical absorption value At (f0, L, S, Si, di, Zi) of Expression (2) obtained as described above is larger than 0.75, the soundproof structure body 10 according to the embodiment of the present invention can be obtained.

Furthermore, in a case where a resonance frequency on an upstream side of a sound source is lower than a resonance frequency on a downstream side, it is possible to obtain high absorption in a range in which the interval L is smaller than $\lambda/4$.

This is because the resonance frequency of the sound on the downstream side is different from the resonance frequency on the upstream side, and in particular, in a case where the resonance frequency on the downstream side is low and the sound on the downstream side other than the resonance frequency reaches the downstream side, a phase is added and reflection occurs from the viewpoint of an imaginary part of an impedance is not 0.

On the other hand, in the prior art described in JP2944552B, only the impedance resistance (impedance real part) of the upstream side structure and impedance resistance (impedance real part) of the downstream side structure are discussed, and the imaginary part is not described.

As shown in the derivation of the above theoretical expression (2), it is necessary to reduce the reflectance and the transmittance at the same time in order to obtain high absorption.

That is, it is necessary to obtain the respective components Ac, Bc, Cc, Dc of the matrix Tc in consideration of each of the matrix of the resonance structure on the upstream side, the matrix corresponding to the distance between the upstream side and the downstream side, and the matrix of the impedance structure on the downstream side, and the reflection coefficient rc and the transmission coefficient tc from the synthetic acoustic impedance Zc, and the high absorbance may not always be obtained only by specifying the impedance resistance of the upstream side structure and the impedance resistance of the downstream side structure.

Figure 7:
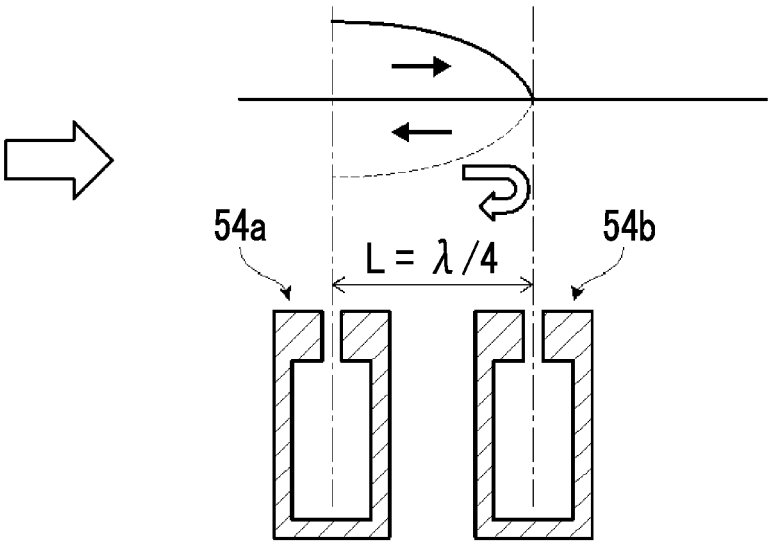
FIG. 7 is an illustration diagram illustrating a disposition of two resonance structures in a silencer described in JP2944552B.

As shown in FIG. 7, in the prior art described in JP2944552B, an upstream side resonator is placed at a position where a sound pressure is increased by an interference of an incident sound and a reflected sound. That is, in order to obtain high absorption, it is preferable that an interval between the upstream side and the downstream side is $(2n-1)\lambda/4$.

Figure 8:
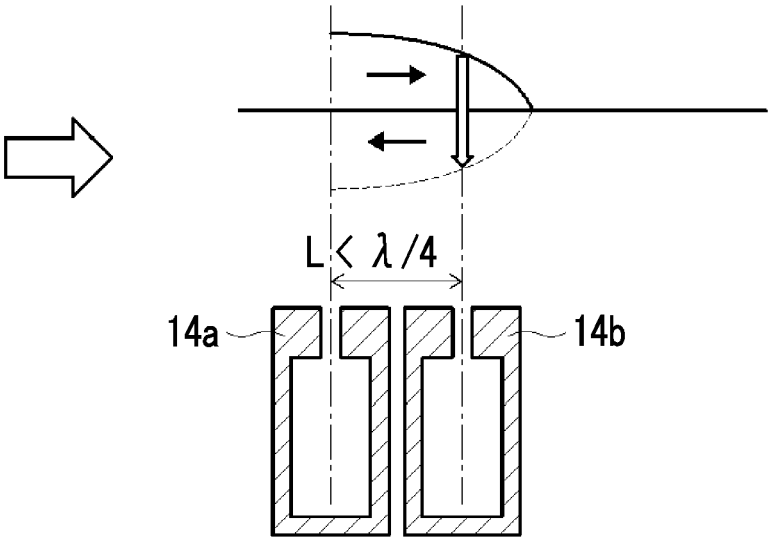
FIG. 8 is an illustration diagram illustrating a disposition of two resonance structures in a soundproof structure body of the present invention.

On the other hand, in the present invention, as shown in FIG. 8 and as described above, by adopting the resonance frequency on the upstream side and the resonance frequency on the downstream side, which are different from each other, the phase of the reflected wave can be modulated, and the high absorption can be provided even in a case of $L<\lambda/4$. That is, the high absorption can be realized with a smaller soundproof structure body.

On the other hand, in the above described prior art, although the impedance resistances (impedance real parts)

of the resonator on the upstream side and the resonator on the downstream side is specified, a reactance component (impedance imaginary part) necessary to add a phase difference is not specified. Therefore, the high absorption cannot be realized with a smaller soundproof structure body.

The key to miniaturizing the soundproof structure body is that the imaginary part of the impedance imparting the phase to the reflected wave is different from that of the upstream side, that is, the resonance frequencies are different from each other.

As described above, it is preferable that the resonance frequency of the resonance structure 14*a* on the upstream side in the waveguide forward direction (the propagation direction or traveling direction of sound) is higher than the resonance frequency of the resonance structure 14*b* on the downstream side. The resonance frequency of the resonance structure 14*a* on the upstream side higher than the resonance frequency of the resonance structure 14*b* on the downstream side is a condition for changing the phase of the reflected wave and achieving miniaturization.

In addition, it is preferable that the interval L between the resonance structure 14*a* on the upstream side and the resonance structure 14*b* on the downstream side is $L<\lambda(f0)/4$ in a case where the wavelength of the resonance frequency f0 is $\lambda(f0)$. Thereby, the soundproof structure body 10 can be miniaturized.

In addition, it is preferable that with respect to a wavelength $\lambda(f0)$ of a frequency satisfying Expression (1), the cross-sectional area S of the opening tube line 12*a* of the tubular body 12 in the soundproof structure body 10 satisfies $S<\pi(\lambda/2)^2$ is satisfied. This is because in a case where this condition is not satisfied, a spatial mode (transverse mode) is formed in a cross-sectional direction of the opening tube line and propagation of a plane wave does not occur, and as a result, the theoretical expression of the present invention cannot be applied.

Figure 9:
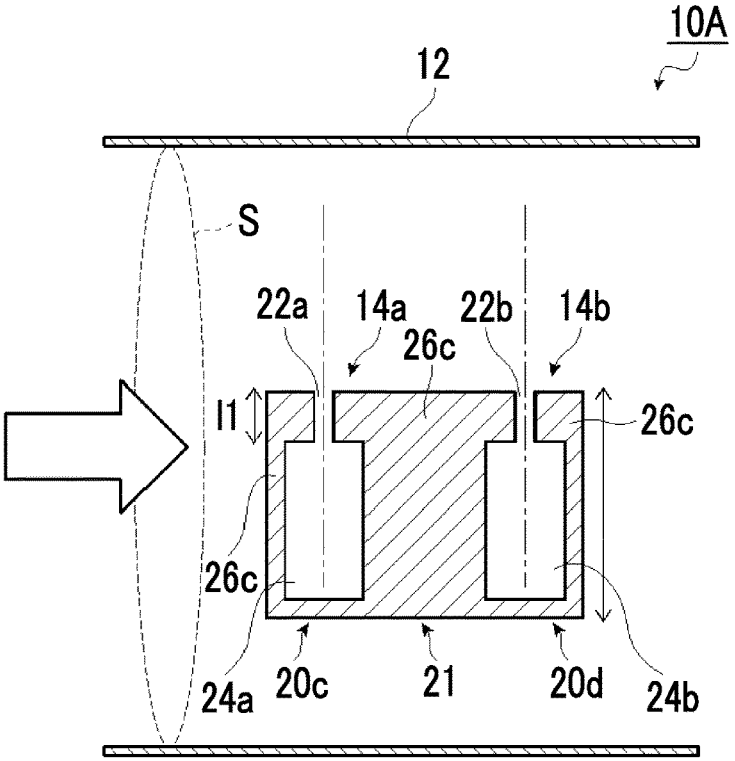
FIG. 9 is a cross-sectional view schematically showing an example of a soundproof structure body according to another embodiment of the present invention.

Furthermore, the two Helmholtz resonance structures 20*a* and 20*b* shown in FIG. 1 are integrated, such as the soundproof structure body 10A shown in FIG. 9, and an integrated resonance structure 21 including two integrated Helmholtz resonance structures 20*c* and 20*d* are provided in an integrated housing 26*c* may be used. That is, the two Helmholtz resonance structures 20*c* and 20*d* of the integrated resonance structure 21 may be used as the two resonance structures 14*a* and 14*b*. Here, the two Helmholtz resonance structures 20*c* and 20*d* include resonance holes 22*a* and 22*b* and hollow spaces 24*a* and 24*b*, respectively. The two Helmholtz resonance structures 20*c* and 20*d* have the same configuration as the Helmholtz resonance structures 20*a* and 20*b* shown in FIG. 1 except that the two Helmholtz resonance structures 20*c* and 20*d* are integrated. Furthermore, three or more resonance structures may be integrated.

That is, at least two resonance structures, thus a plurality of resonance structures, may be integrated.

Thereby, a large number of discontinuous cross-sections as shown in FIG. 6 can be reduced, unnecessary reflected waves can be reduced, and the design can be simplified.

EXAMPLES

The soundproof structure body according to the embodiment of the present invention will be specifically described based on Examples.

Example 1

First, a soundproof structure body 10 according to the embodiment of the present invention shown in FIG. 1 was produced as Example 1.

As shown in FIG. 1, in the soundproof structure body 10 of Example 1, the Helmholtz resonance structures 20*a* and 20*b* were used as the two resonance structures 14*a* and 14*b*, respectively, and were installed in the opening tube line 12*a* of the tubular body 12 to be spaced apart at a predetermined interval L.

Various parameters of the soundproof structure body 10 of Example 1 were as follows.

Cross-sectional area S of opening cross-section 12*b* of tubular body 12=1257 [$mm^2$]

Interval L between two resonance structures 14 adjacent to each other=17 [mm]

Cross-sectional area S1 of resonance structure 14*a* (Helmholtz resonance structure 20*a*)=648 [$mm^2$]

Cross-sectional area S2 of resonance structure 14*b* (Helmholtz resonance structure 20*b*)=648 [$mm^2$]

Width d1 of resonance structure 14*a* (Helmholtz resonance structure 20*a*)=14 [mm]

Width d2 of resonance structure 14*b* (Helmholtz resonance structure 20*b*)=14 [mm]

Cross-sectional area Sn1 of resonance hole 22*a* of Helmholtz resonance structure 20*a*=49.0 [$mm^2$]

Cross-sectional area Sn2 of resonance hole 22*b* of Helmholtz resonance structure 20*b*=45.5 [$mm^2$]

Length l1 of resonance hole 22*a* of Helmholtz resonance structure 20*a*=5 [mm]

Length l2 of resonance hole 22*b* of Helmholtz resonance structure 20*b*=5 [mm]

Volume V1 of hollow space 24*a* of Helmholtz resonance structure 20*a*=4000 [$mm^3$]

Volume V2 of hollow space 24*b* of Helmholtz resonance structure 20*b*=4000 [$mm^3$]

Comparative Example 1-1

A soundproof structure body having the same structure as in Example 1 was used as a soundproof structure body of Comparative Example 1-1. Various parameters of the soundproof structure body of Comparative Example 1-1 were as follows.

Cross-sectional area S of opening cross-section of tubular body=1257 [$mm^2$]

Interval L between two resonance structures adjacent to each other=17 [mm]

Cross-sectional area S1 of resonance structure (Helmholtz resonance structure) on upstream side=648 [$mm^2$]

Cross-sectional area S2 of resonance structure (Helmholtz resonance structure) on downstream side=648 [$mm^2$]

Width d1 of resonance structure (Helmholtz resonance structure) on upstream side=14 [mm]

Width d2 of resonance structure (Helmholtz resonance structure) on downstream side=14 [mm]

Cross-sectional area Sn1 of resonance hole of Helmholtz resonance structure on upstream side=49.0 [$mm^2$]

Cross-sectional area Sn2 of resonance hole of Helmholtz resonance structure on downstream side=49.0 [$mm^2$]

Length l1 of resonance hole of Helmholtz resonance structure on upstream side=5 [mm]

Length l2 of resonance hole of Helmholtz resonance structure on downstream side=5 [mm]

Volume V1 of hollow space of Helmholtz resonance structure on upstream side=4000 [$mm^3$]

Volume V2 of hollow space of Helmholtz resonance structure on downstream side=4000 [$mm^3$]

That is, Comparative Example 1-1 was different from Example 1 in that the cross-sectional areas Sn1 and Sn2 of the resonance holes of the two Helmholtz resonance structures were set to the same 49.0 [$mm^2$].

Comparative Example 1-2

Figure 10:
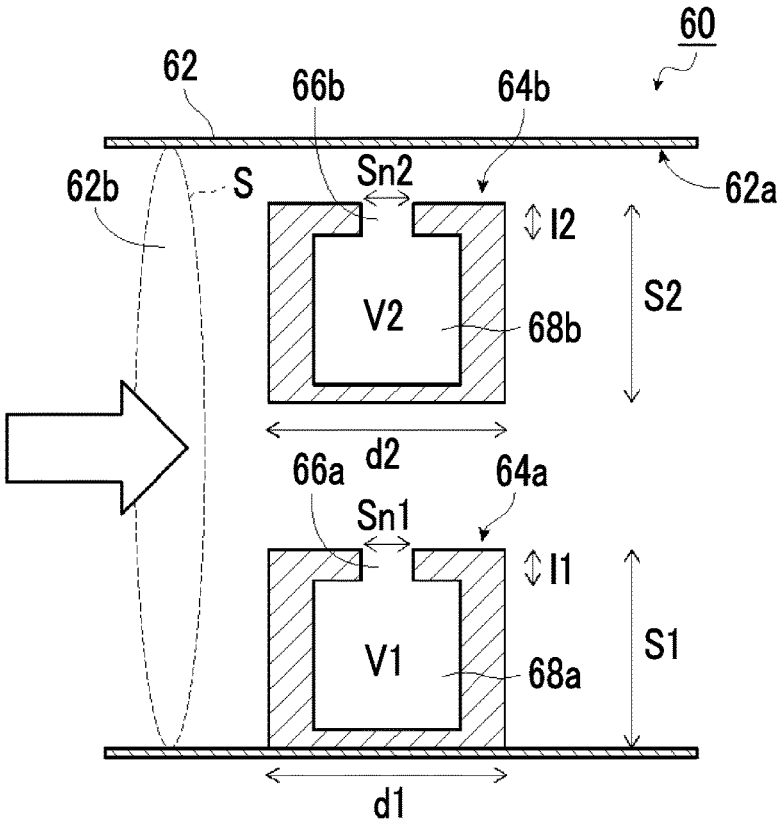
FIG. 10 is a cross-sectional view schematically showing soundproof structure bodies of Comparative Examples 1-2 and 1-3.

As shown in FIG. 10, two Helmholtz resonance structures 64*a* and 64*b* were vertically installed as resonance structures in an opening tube line 62*a* of a tubular body 62 to produce a soundproof structure body 60 of Comparative Example 1-2. The tubular body 62 and the Helmholtz resonance structures 64*a* and 64*b* had the same configurations as the tubular body 12 and the Helmholtz resonance structures 20*a* and 20*b*, respectively.

Various parameters of the soundproof structure body 60 of Comparative Example 1-2 were as follows.

Cross-sectional area S of opening cross-section of tubular body=1257 [$mm^2$]

Interval L between two Helmholtz resonance structures 64*a* and 64*b*=0 [mm]

Cross-sectional area S1 of Helmholtz resonance structure 64*a* on lower side=378 [$mm^2$]

Cross-sectional area S2 of Helmholtz resonance structure 64*b* on upper side=378 [$mm^2$]

Width d1 of Helmholtz resonance structure 64*a* on lower side=24 [mm]

Width d2 of Helmholtz resonance structure 64*b* on upper side=24 [mm]

Cross-sectional area Sn1 of resonance hole 66*a* of Helmholtz resonance structure 64*a* on lower side=49.0 [$mm^2$]

Cross-sectional area Sn2 of resonance hole 66*b* of Helmholtz resonance structure 64*b* on upper side=45.5 [$mm^2$]

Length l1 of resonance hole 66*a* of Helmholtz resonance structure 64*a* on lower side=5 [mm]

Length l2 of resonance hole 66*b* of Helmholtz resonance structure 64*b* on upper side=5 [mm]

Volume V1 of hollow space 68*a* of Helmholtz resonance structure 64*a* on lower side=4000 [$mm^3$]

Volume V2 of hollow space 68*b* of Helmholtz resonance structure 64*b* on upper side=4000 [$mm^3$]

That is, Comparative Example 1-2 was different from Example 1 in the interval L between the two Helmholtz resonance structures 64*a* and 64*b*, and the cross-sectional areas S1 and S2.

Comparative Example 1-3

A soundproof structure body 60 of Comparative Example 1-3 was produced to have the same configuration as in Comparative Example 1-2, except that in the soundproof structure body 60 shown in FIG. 10, the cross-sectional areas Sn1 and Sn2 of the resonance holes 66*a* and 66*b* in the two Helmholtz resonance structures 64*a* and 64*b* were the same as each other.

Various parameters of the soundproof structure body 60 of Comparative Example 1-3 were as follows.

Cross-sectional area S of opening cross-section of tubular body=1257 [$mm^2$]

Interval L between two Helmholtz resonance structures 64*a* and 64*b*=0 [mm]

Cross-sectional area S1 of Helmholtz resonance structure 64*a* on lower side=378 [$mm^2$]

Cross-sectional area S2 of Helmholtz resonance structure 64*b* on upper side=378 [$mm^2$]

Width d1 of Helmholtz resonance structure 64*a* on lower side=24 [mm]

Width d2 of Helmholtz resonance structure 64*b* on upper side=24 [mm]

Cross-sectional area Sn1 of resonance hole 66*a* of Helmholtz resonance structure 64*a* on lower side=49.0 [$mm^2$]

Cross-sectional area Sn2 of resonance hole 66*b* of Helmholtz resonance structure 64*b* on upper side=49.0 [$mm^2$]

Length l1 of resonance hole 66*a* of Helmholtz resonance structure 64*a* on lower side=5 [mm]

Length l2 of resonance hole 66*b* of Helmholtz resonance structure 64*b* on upper side=5 [mm]

Volume V1 of hollow space 68*a* of Helmholtz resonance structure 64*a* on lower side=4000 [$mm^3$]

Volume V2 of hollow space 68*b* of Helmholtz resonance structure 64*b* on upper side=4000 [$mm^3$]

Example 2

A soundproof structure body 10 of Example 2 was produced to have the same configuration as in Example 1, except that in the soundproof structure body 10 shown in FIG. 1, the interval L between the two Helmholtz resonance structures 20*a* and 20*b* and the cross-sectional areas S1 and S2 were changed.

Various parameters of the soundproof structure body 10 of Example 2 were as follows.

Cross-sectional area S of opening cross-section 12*b* of tubular body 12=1257 [$mm^2$]

Interval L between two resonance structures 14 adjacent to each other=70 [mm]

Cross-sectional area Si of resonance structure 14*a* (Helmholtz resonance structure 20*a*)=648 [$mm^2$]

Cross-sectional area S2 of resonance structure 14*b* (Helmholtz resonance structure 20*b*)=648 [$mm^2$]

Width d1 of resonance structure 14*a* (Helmholtz resonance structure 20*a*)=14 [mm]

Width d2 of resonance structure 14*b* (Helmholtz resonance structure 20*b*)=14 [mm]

Cross-sectional area Sn1 of resonance hole 22*a* of Helmholtz resonance structure 20*a*=45.5 [$mm^2$]

Cross-sectional area Sn2 of resonance hole 22*b* of Helmholtz resonance structure 20*b*=49.0 [$mm^2$]

Length l1 of resonance hole 22*a* of Helmholtz resonance structure 20*a*=5 [mm]

Length l2 of resonance hole 22*b* of Helmholtz resonance structure 20*b*=5 [mm]

Volume V1 of hollow space 24*a* of Helmholtz resonance structure 20*a*=4000 [$mm^3$]

Volume V2 of hollow space 24*b* of Helmholtz resonance structure 20*b*=4000 [$mm^3$]

That is, the interval L between the two Helmholtz resonance structures 20*a* and 20*b* in Example 2, is longer than Example 1, and the cross-sectional areas Sn1 and Sn2 of the resonance holes 22*a* and 22*b* were in reverse to Example 1.

Comparative Example 2

A soundproof structure body having the same structure as in Example 2 was used as a soundproof structure body of Comparative Example 2. Various parameters of the soundproof structure body of Comparative Example 2 were as follows.

Cross-sectional area S of opening cross-section of tubular body=1257 [$mm^2$]

Interval L between two resonance structures adjacent to each other=70 [mm]

Cross-sectional area S1 of resonance structure (Helmholtz resonance structure) on upstream side=648 [$mm^2$]

Cross-sectional area S2 of resonance structure (Helmholtz resonance structure) on downstream side=648 [$mm^2$]

Width d1 of resonance structure (Helmholtz resonance structure) on upstream side=14 [mm]

Width d2 of resonance structure (Helmholtz resonance structure) on downstream side=14 [mm]

Cross-sectional area Sn 1 of resonance hole of Helmholtz resonance structure on upstream side=49.0 [$mm^2$]

Cross-sectional area Sn2 of resonance hole of Helmholtz resonance structure on downstream side=49.0 [$mm^2$]

Length l1 of resonance hole of Helmholtz resonance structure on upstream side=5 [mm]

Length l2 of resonance hole of Helmholtz resonance structure on downstream side=5 [mm]

Volume V1 of hollow space of Helmholtz resonance structure on upstream side=4000 [$mm^3$]

Volume V2 of hollow space of Helmholtz resonance structure on downstream side=4000 [$mm^3$]

That is, Comparative Example 2 was different from Example 2 in that the cross-sectional areas Sn1 and Sn2 of the resonance holes of the two Helmholtz resonance structures were set to the same 49.0 [$mm^2$].

Reference Example 1

Figure 11:
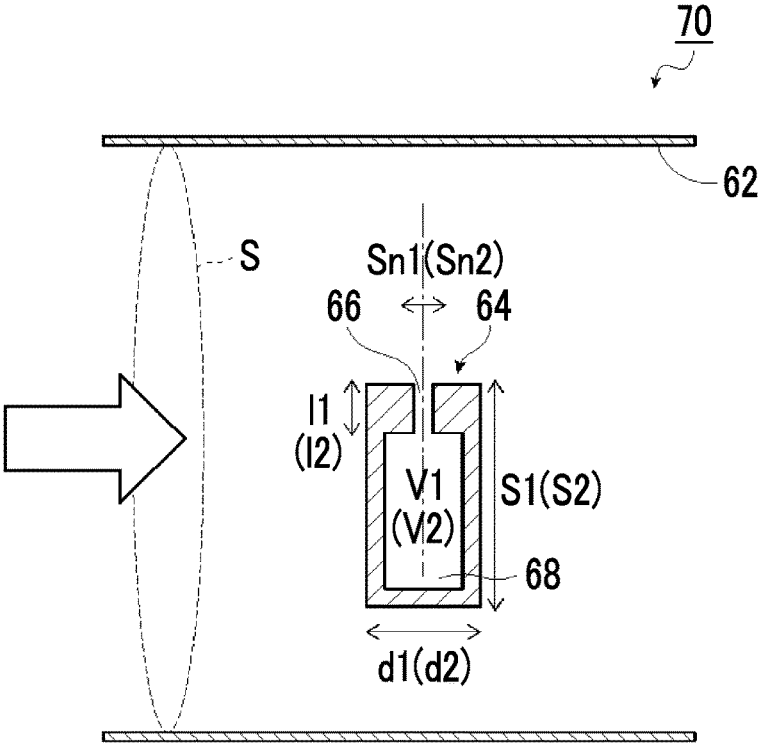
FIG. 11 is a cross-sectional view schematically showing soundproof structure bodies of Reference Examples 1 and 2.

As shown in FIG. 11, a soundproof structure body 70 of Reference Example 1 was produced in the same manner as in Example 1 and Comparative Example 1, except that a single Helmholtz resonance structure 64 was installed as the resonance structure in the opening tube line 62*a* of the tubular body 62.

Various parameters of the soundproof structure body 70 of Reference Example 1 were as follows.

Cross-sectional area S of opening cross-section of tubular body 62=1257 [$mm^2$]

Cross-sectional area S1 of Helmholtz resonance structure 64=648 [$mm^2$]

Width d1 of Helmholtz resonance structure 64=14 [mm]

Cross-sectional area Sn1 of resonance hole 66 of Helmholtz resonance structure 64=49.0 [$mm^2$]

Length l1 of resonance hole 66 of Helmholtz resonance structure 64=5 [mm]

Volume V1 of hollow space 68 of Helmholtz resonance structure 64=4000 [$mm^3$]

That is, it can be said that only the Helmholtz resonance structure (20*a*) on the upstream side in Example 1 and Comparative Example 1 was installed in Reference Example 1.

Reference Example 2

A soundproof structure body 70 of Reference Example 2 was produced in the same manner as in Reference Example 1 except that in the soundproof structure body 70 shown in FIG. 11, the cross-sectional area of the resonance hole 66 of the single Helmholtz resonance structure 64 was changed.

Various parameters of the soundproof structure body 70 of Reference Example 2 were as follows.

Cross-sectional area S of opening cross-section of tubular body 62=1257 [$mm^2$]

Cross-sectional area S2 of Helmholtz resonance structure 64=648 [$mm^2$]

Width d2 of Helmholtz resonance structure 64=14 [mm]

Cross-sectional area Sn2 of resonance hole 66 of Helmholtz resonance structure 64=45.5 [$mm^2$]

Length l1 of resonance hole 66 of Helmholtz resonance structure 64=5 [mm]

Volume V1 of hollow space 68 of Helmholtz resonance structure 64=4000 [$mm^3$]

That is, it can be said that only the Helmholtz resonance structure (20*b*) on the downstream side in Example 1 and Comparative Example 1 was installed in Reference Example 2.

Reference Example 3

Figure 12:
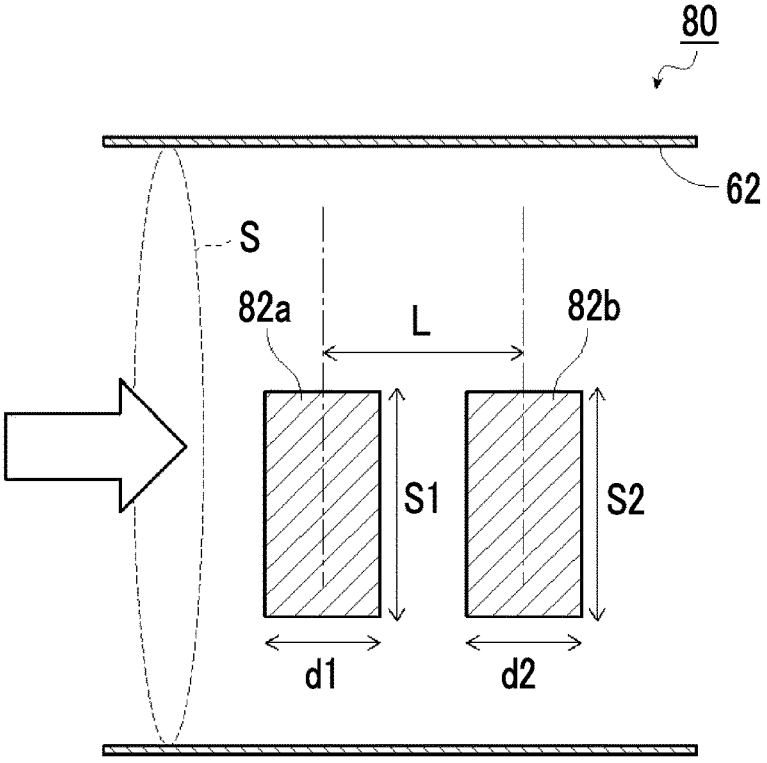
FIG. 12 is a cross-sectional view schematically showing a soundproof structure body of Reference Example 3.
Figure 13:
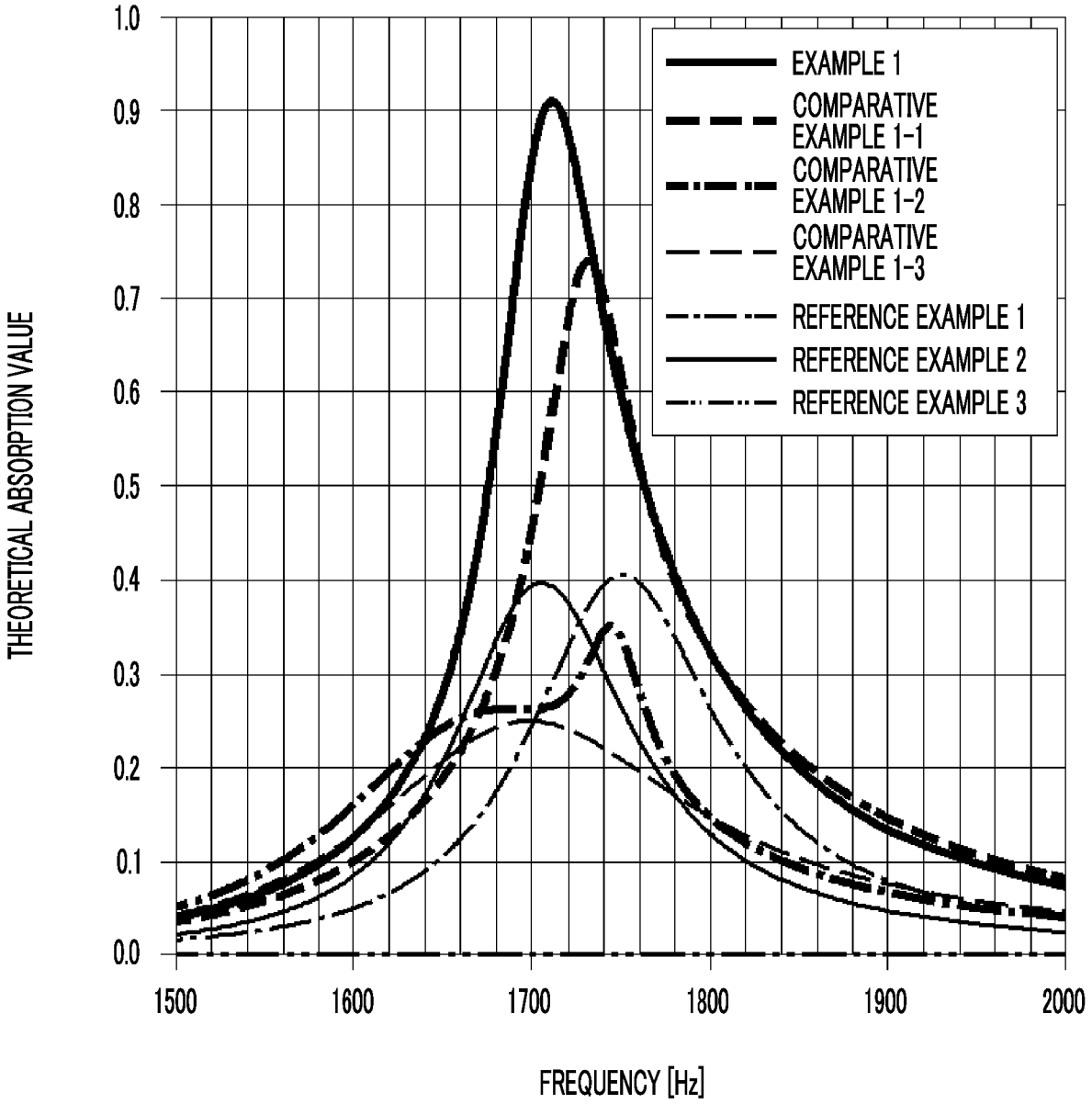
FIG. 13 is a graph showing a relationship between theoretical absorption values and frequencies of the soundproof structure body in Example 1 and the soundproof structure bodies in Comparative Examples 1-1 and 1-2.
Figure 14:
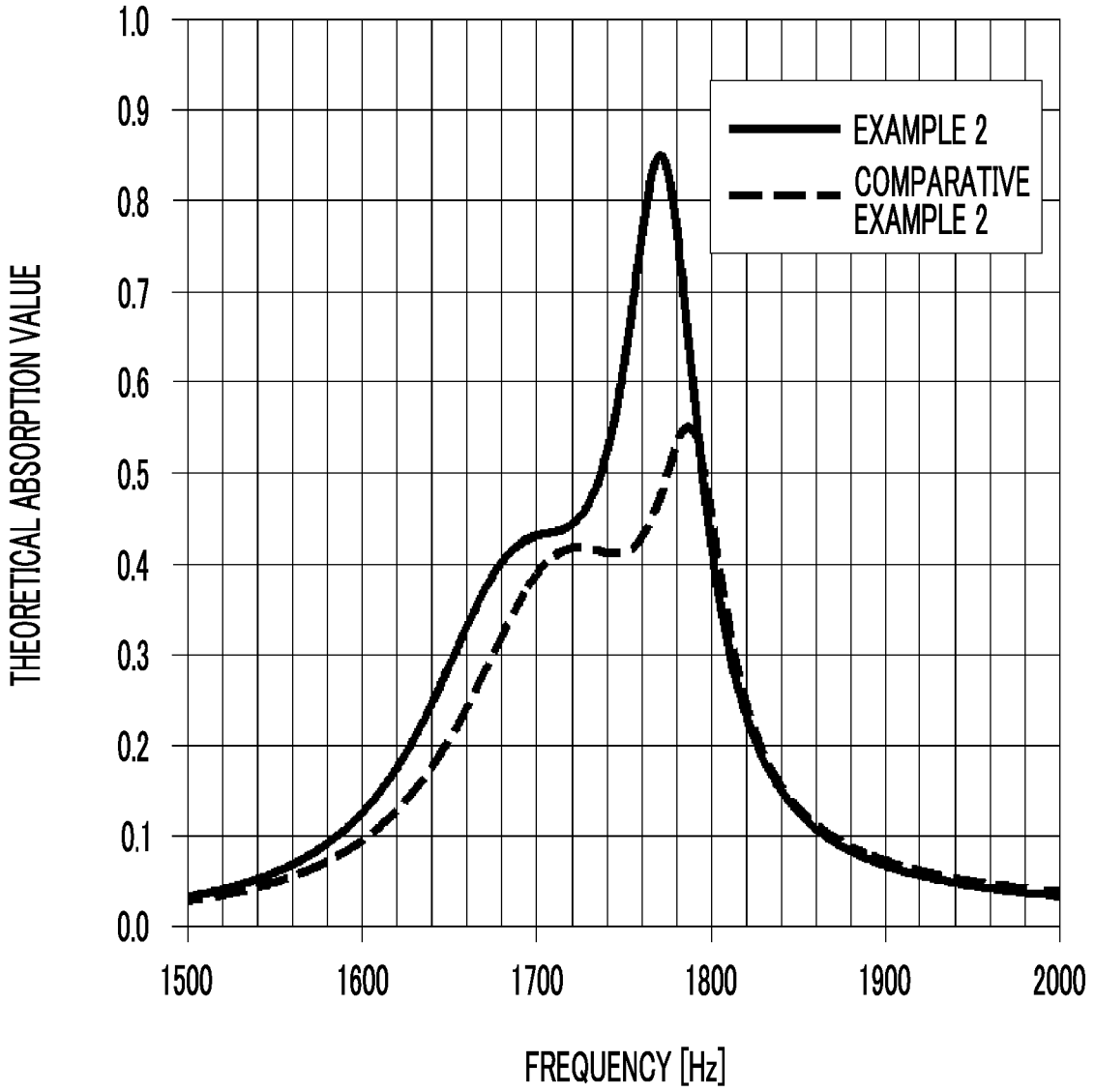
FIG. 14 is a graph showing a relationship between theoretical absorption values and frequencies of the soundproof structure body in Example 2 and the soundproof structure body in Comparative Example 2.
Figure 15:
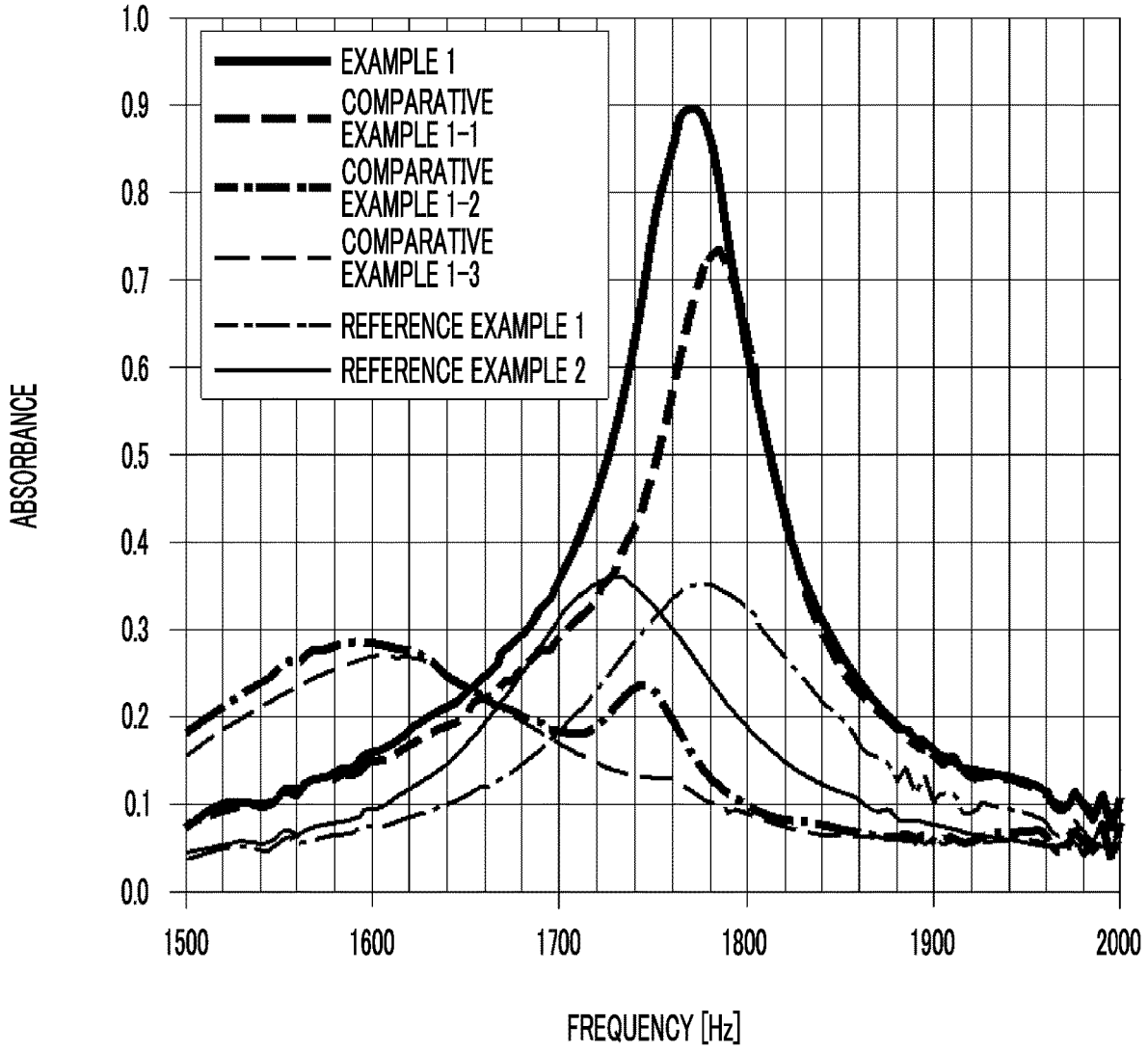
FIG. 15 is a graph showing a relationship between absorbances and frequencies of the soundproof structure body in Example 1 and the soundproof structure bodies in Comparative Examples 1-1 and 1-2.
Figure 16:
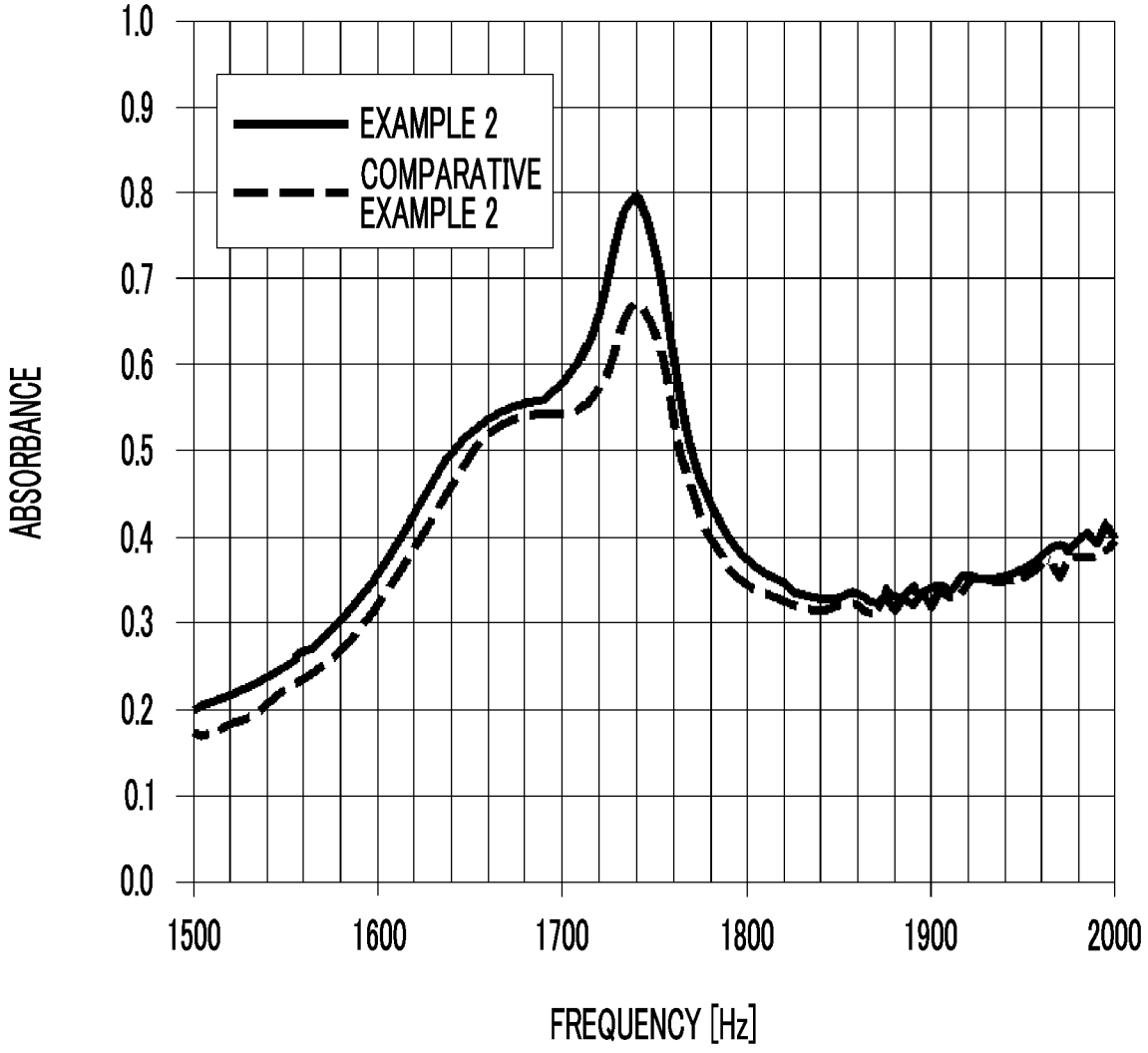
FIG. 16 is a graph showing a relationship between absorbances and frequencies of the soundproof structure body in Example 2 and the soundproof structure body in Comparative Example 2.
Figure 17:
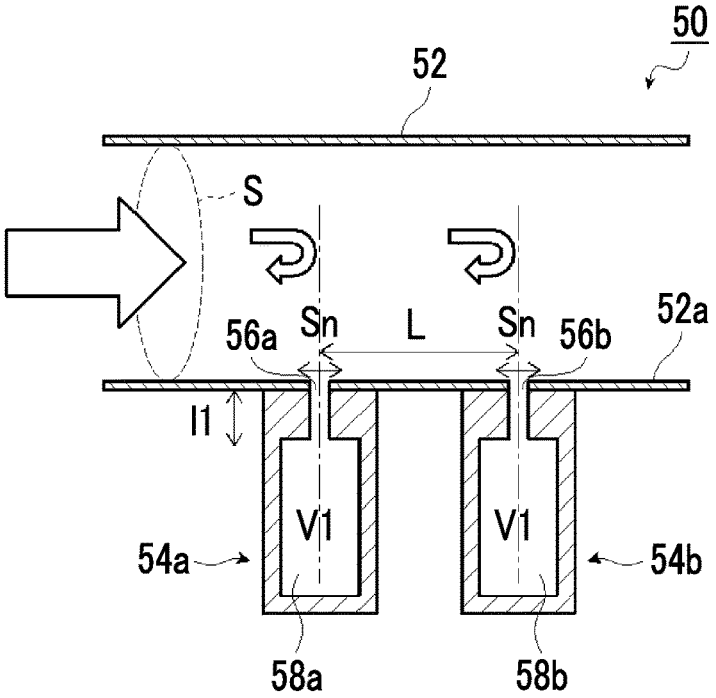
FIG. 17 is a cross-sectional view schematically showing a soundproof structure body in an example in the related art (JP2944552B).
Figure 18:
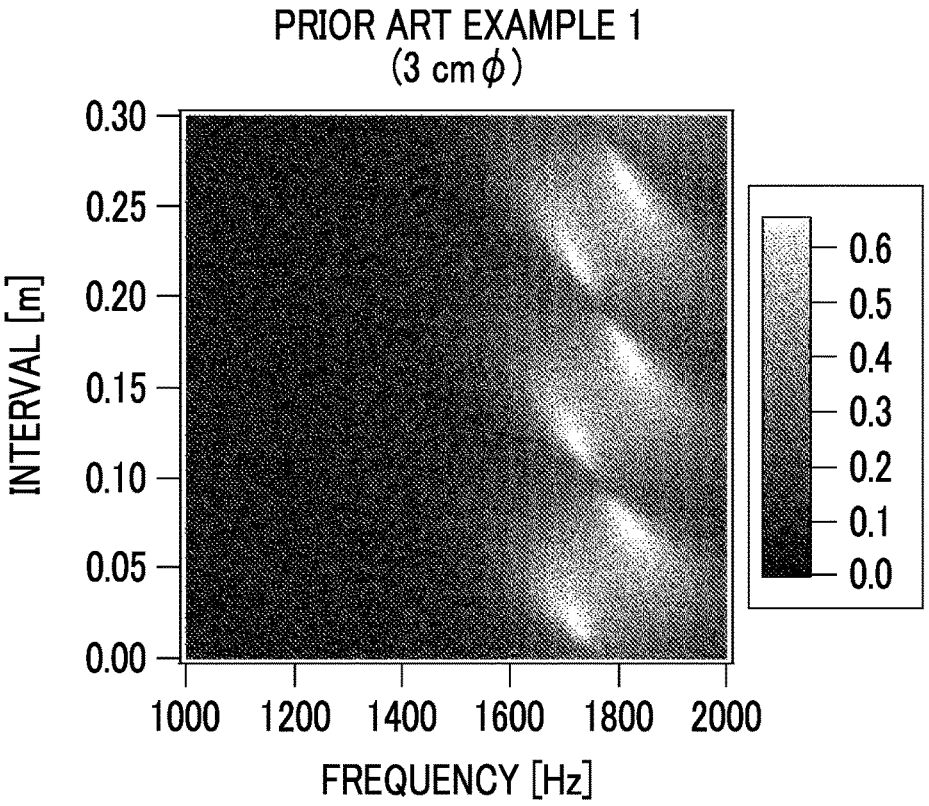
FIG. 18 is a two-dimensional graph showing a relationship between a frequency, an interval, and an absorbance of a soundproof structure body in another example in the related art (prior art example 1).
Figure 19:
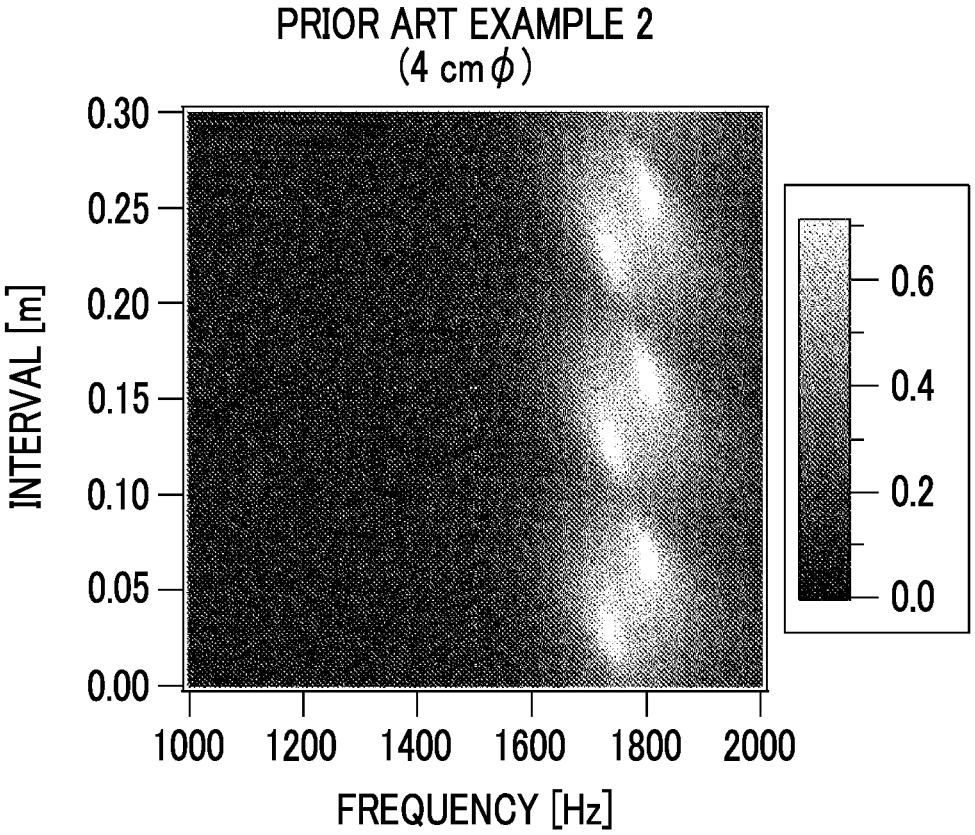
FIG. 19 is a two-dimensional graph showing a relationship between a frequency, an interval, and an absorbance of a soundproof structure body in another example in the related art (prior art example 2).
Figure 20:
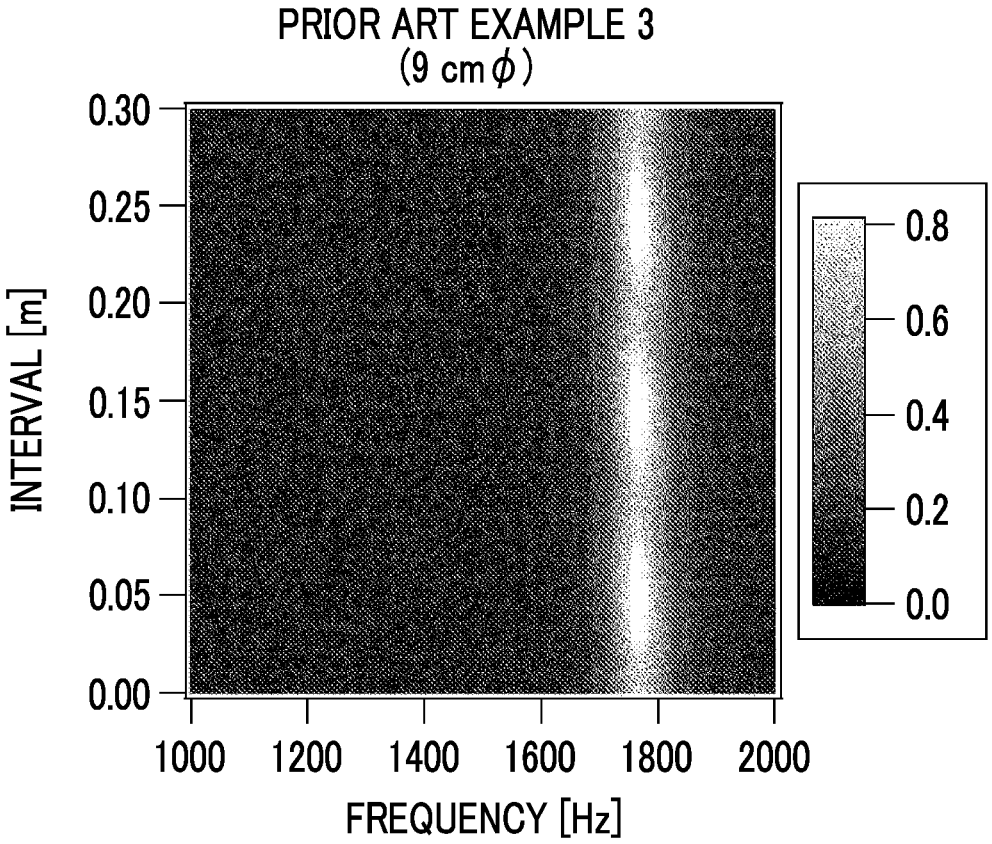
FIG. 20 is a two-dimensional graph showing a relationship between a frequency, an interval, and an absorbance of a soundproof structure body in another example in the related art (prior art example 3).
Figure 21:
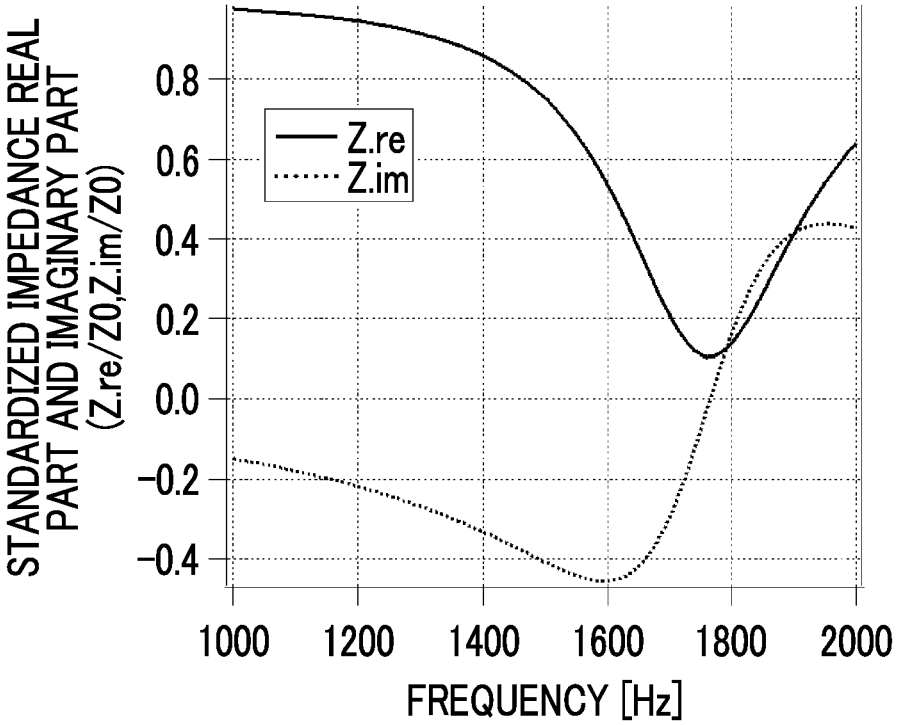
FIG. 21 is a two-dimensional graph showing an impedance real part of a single structure of a resonance structure of the soundproof structure body in the other example in the related art (prior art example 1), and a relationship between an imaginary part and a frequency.
Figure 22:
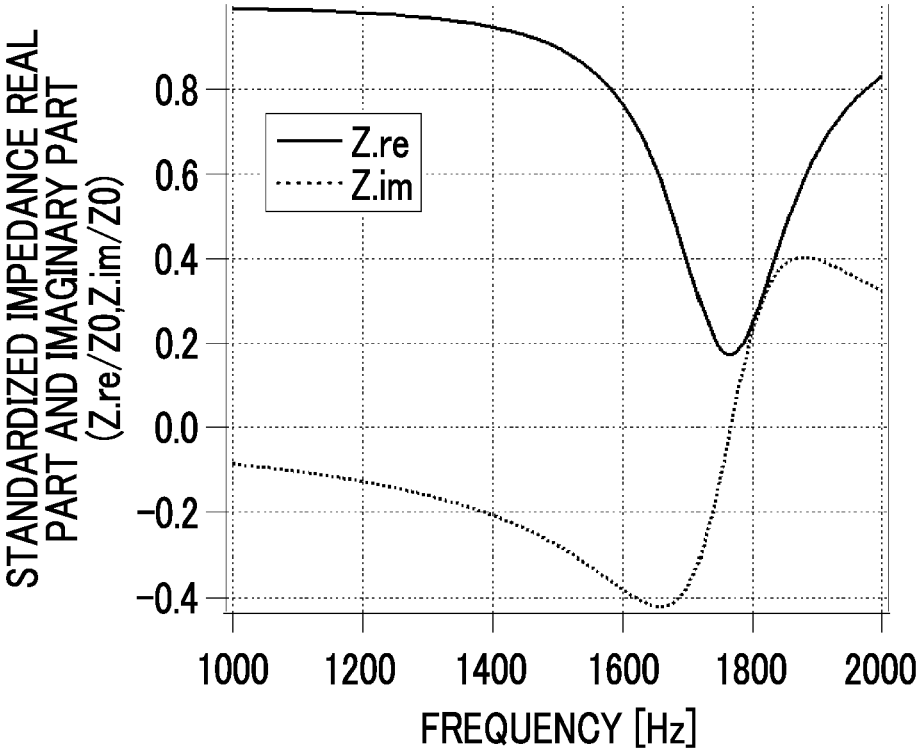
FIG. 22 is a two-dimensional graph showing an impedance real part of a single structure of a resonance structure of the soundproof structure body in the other example in the related art (prior art example 2), and a relationship between an imaginary part and a frequency.
Figure 23:
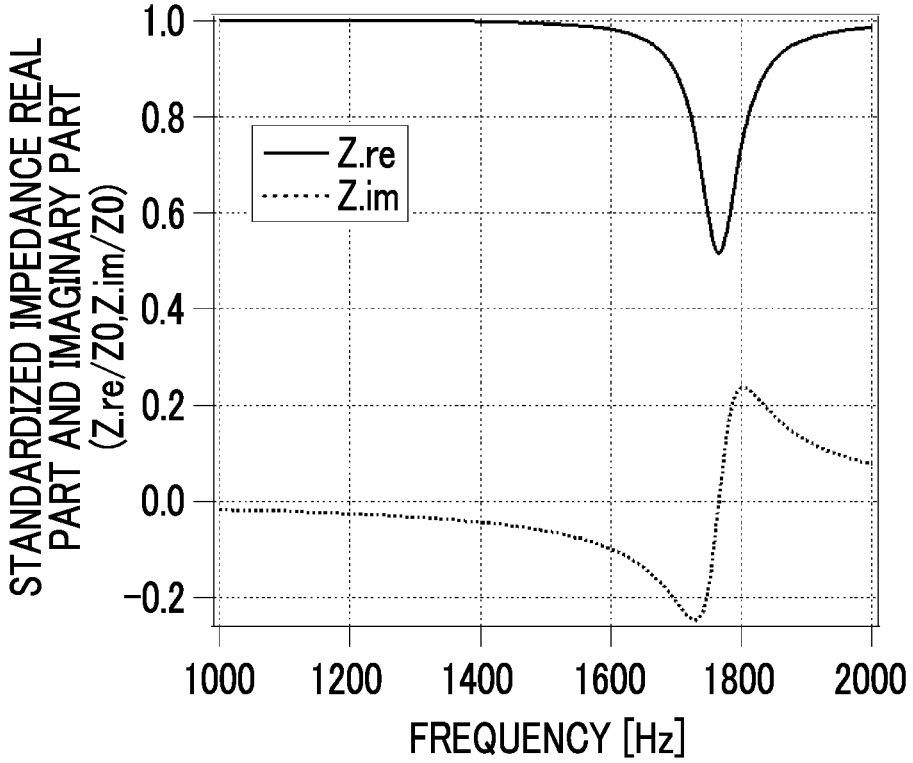
FIG. 23 is a two-dimensional graph showing an impedance real part of a single structure of a resonance structure of the soundproof structure body in the other example in the related art (prior art example 3), and a relationship between an imaginary part and a frequency.

As shown in FIG. 12, a structure body 80 of Reference Example 3 was produced in the same manner as in Example 1, except that two obstacles that do not function as the resonance structure and that are simply rectangular parallelepiped were installed to be spaced apart from each other in the opening tube line 62*a* of the tubular body 62.

Various parameters of the structure body 80 of Reference Example 3 were as follows.

Cross-sectional area S of opening cross-section of tubular body 62=1257 [$mm^2$]

Interval L between two obstacles 82*a* and 82*b* adjacent to each other=17 [mm]

Cross-sectional area S1 of obstacle 82*a*=648 [$mm^2$]

Cross-sectional area S2 of obstacle 82*b*=648 [$mm^2$]

Width d1 of obstacle 82*a*=14 [mm]

Width d2 of obstacle 82*b*=14 [mm]

Theoretical absorption values At (f0) were obtained by numerically calculating Expression (2) that is based on the theoretical calculation for the soundproof structure bodies (10, 60, and 70) of Examples 1 and 2, Comparative Examples 1-1, 1-2, 1-3, and 2, and Reference Examples 1, 2, and 3 having such configurations.

In addition, acoustic characteristics of the soundproof structure bodies (10, 60, 70) of Examples 1 and 2, Comparative Examples 1-1, 1-2, 1-3, and 2, and Reference Examples 1, 2, and 3 were measured by a four-microphone method, respectively. Maximum values were extracted from an absorbance spectrum measured as described above to obtain maximum absorbances.

An acoustic measurement was performed as follows using an acoustic tube having an inner diameter of 8 cm.

The acoustic characteristics were measured by a transfer function method using an aluminum acoustic tube (tubular body) with four-microphones. This method complies with "ASTM E2611-09: Standard Test Method for Measurement of Normal Incidence Sound Transmission of Acoustical Materials Based on the Transfer Matrix Method". As the acoustic tube, an aluminum tubular body having the same measurement principle as, for example, WinZac manufactured by Nittobo Acoustic Engineering Co., Ltd. was used. A cylindrical box (not shown) accommodating a speaker (not shown) was disposed inside the tubular body, and the tubular body was placed on the box (not shown). Sound with a predetermined sound pressure was output from a speaker (not shown), and measurement was performed with four-microphones. In this manner, a sound transmission loss can be measured in a wide spectrum band. For example, the soundproof structure body 10 of Example 1 was disposed at a predetermined measurement site of a tubular body serving as an acoustic tube, and the acoustic absorbance was measured in a range of 100 Hz to 4000 Hz.

Results of calculating theoretical absorption values At(f0) of the soundproof structure bodies of Examples 1 and 2, Comparative Examples 1-1, 1-2, 1-3, and 2, and Reference Examples 1, 2, and 3, and results of measuring the maximum absorbances are shown in Tables 1 and 2. Theoretical absorption values of Examples 1 and 2, Comparative Examples 1-1, 1-2, 1-3, and 2 and absorbances obtained by experiments are shown in FIG. 13 to FIG. 16.

TABLE 1

| — | f0 | f1 [Hz] | f2 [Hz] | At (theoretical absorption value) | Maximum absorbance (experiment) |
|---|---|---|---|---|---|
| Example 1 | 1711 | 1750 | 1705 | 0.91 | 0.90 |
| Comparative Example 1-1 | 1731 | 1750 | 1750 | 0.74 | 0.73 |
| Comparative Example 1-2 | 1744 | 1750 | 1750 | 0.35 | 0.29 |
| Comparative Example 1-3 | 1727 | 1750 | 1750 | 0.25 | 0.27 |
| Reference Example 1 | 1750 | 1750 | — | 0.41 | 0.35 |
| Reference Example 2 | 1705 | — | 1705 | 0.40 | 0.36 |
| Reference Example 3 | — | — | — | 0.00 | — |

TABLE 2

| — | f0 | f1 [Hz] | f2 [Hz] | At (theoretical absorption value) | Maximum absorbance (experiment) |
|---|---|---|---|---|---|
| Example 2 | 1771 | 1705 | 1750 | 0.85 | 0.80 |
| Comparative Example 2 | 1790 | 1750 | 1750 | 0.55 | 0.67 |

From the results shown in Tables 1 to 2 and FIG. 13 to FIG. 16, it was found that the higher maximum absorbances in Examples 1 and 2 that satisfies the condition of Expression (1) of the present invention than Comparative Examples 1-1 to 1-3, Comparative Example 2, and Reference Examples 1 to 3 that do not satisfy Expression (1) was obtained.

As described above, the effectiveness of the present invention was exhibited.

In addition, it was found that in Example 1 in which the resonance frequencies of the two resonance structures that are installed to be spaced apart from each other are different from each other, the resonant opening interval is 17 mm and is smaller than λ/4 of the wavelength of the resonance frequency of 1711 Hz, that is, miniaturization can be achieved.

As described above, the effect of the present invention is clearly exhibited.

The soundproof structure body according to the embodiment of the present invention can be used for a copying machine, a blower, an air conditioning machine, a ventilator, pumps, a generator, a duct, industrial equipment such as various kinds of manufacturing devices emitting a sound such as a coater, a rotating machine, and a carrier machine, transportation equipment such as an automobile, an electric train, and an aircraft, and general household equipment such as a refrigerator, a washing machine, a dryer, a television, a copier, a microwave, a game machine, an air conditioner, a fan, a personal computer, a vacuum cleaner, and an air cleaner.

As above, the soundproof structure body according to the embodiment of the present invention has been described in detail with reference to various embodiments and examples, but the present invention is not limited to these embodiments and examples, and it goes without saying that various improvements and modifications may be made without departing from the spirit of the present invention.

EXPLANATION OF REFERENCES

10, 10A, 10B, 10C, 60, 70: soundproof structure body
12, 62: tubular body
12*a*, 62*a*: opening tube line
12*b*, 62*b*: opening cross-section
14, 14*a*, 14*b*: resonance structure
16: venthole
20, 20*a*, 20*b*, 20*c*, 20*d*, 64, 64*a*, 64*b*: Helmholtz resonance structure
21: integrated resonance structure
22, 22*a*, 22*b*, 66, 66*a*, 66*b*: resonance hole
24, 24*a*, 24*b*, 68, 68*a*, 68*b*: hollow space
26, 26*a*, 26*b*: housing
26*c*: integrated housing
30: film resonance structure
32: frame
33*a*: surrounding portion
33*b*: bottom portion
34: hole portion
36: film
38: back space
40, 40*a*, 40*b*: air column resonance structure
42, 42*a*, 42*b*: opening
44, 44*a*, 44*b*: bottom surface
46, 46*a*, 46*b*: tubular body
50: silencer
52: duct
52*a*: tube wall
54*a*, 54*b*: resonator
56*a*, 56*b*: resonant opening
58*a*, 58*b*: internal hollow space
80: structure body
82: obstacle

What is claimed is:

1. A soundproof structure body comprising:

an opening member that forms an opening tube line having a cross-sectional area S; and at least two resonance structures for sound waves that are installed inside the opening tube line, wherein a cross-sectional area Si (i=1, 2, . . . , where the resonance structure having a smaller i number is located on an upstream side) in the opening tube line and a width di (i=1, 2, . . . ) of the resonance structure in a waveguide forward direction are more than 0, at least two resonance structures among the resonance structures are installed to be spaced apart at an interval L (L>0) from each other, and in a case where an impedance of each of the two resonance structures installed to be spaced apart at the interval L from each other is defined as Zi (i=1, 2), and a synthetic acoustic impedance, in which the two resonance structures and the interval thereof, a change in the cross-sectional area in the waveguide forward direction, and the two resonance structures are considered, is defined as Zc, a condition of Expression (1) is satisfied at a resonance frequency f0 at which a theoretical absorption value At given by Expression (2) is a maximum value, $$At(f0, L, S, Si, di, Zi)>0.75 \quad (1),$$

where, in a case where L>0, S>0, Si(i=1, 2)>0, di(i=1, 2)>0, and, f, L, S, Si, di, Zi (i=1, 2) is represented by x, $$At(x)=1-|(Zc(x)-Z0)/(Zc(x)+Z0)|^2-|2/(Ac(x)+Bc(x)/Z0+Z0Cc(x)+Dc(x))|^2 \quad (2),$$

where, the synthetic acoustic impedance Zc(x) is defined by Expression (3)

$$Z_C(x) = \frac{Z_0 A_C(x) + B_C(x)}{Z_0 C_C(x) + D_C(x)}, \tag{3}$$

in Expression (3), Z0 is an acoustic impedance of an opening tube line represented by Zair/S(=Z0) (S is a tube line cross-sectional area), Zair denotes an acoustic impedance of air and is given by Zair=ρc, ρ denotes a density of air, and c denotes a speed of sound, Ac(x), Bc(x), Cc(x), and Dc(x) are elements of a synthetic transfer matrix, and are defined by Expression (4), and in Expression (4), Tc is a synthetic transfer matrix of the two resonance structures $$\begin{aligned} T_C &= T_{d1/2} T_1 T_{d1/2} T_{L-d1/2-d2/2} T_{d2/2} T_2 T_{d2/2} \\ &= \begin{pmatrix} A_C(x) & B_C(x) \\ C_C(x) & D_C(x) \end{pmatrix}, \end{aligned} \tag{4}$$

$T_i$(i=1, 2) is a transfer matrix corresponding to a resonance structure in each of the two resonance structures, and is defined by Expression (5)

$$T_i = \begin{pmatrix} 1 & 0 \\ \frac{1}{Z_1} & 1 \end{pmatrix}, \tag{5}$$

$T_{di/2}$ is a transfer matrix corresponding to a distance of a resonance structure in each of the two resonance structures, and is defined by Expression (6)

$$T_{di/2} = \begin{pmatrix} \cos k\frac{d}{2} & i\frac{Z_{air}}{s - s_i}\sin k\frac{d}{2} \\ i\frac{s - s_i}{Z_{air}}\sin k\frac{d}{2} & \cos k\frac{d}{2} \end{pmatrix} \tag{6}$$

$(i = 1, 2)$, and $T_{L-d1/2-d2/2}$ is a transfer matrix corresponding to a distance between the two resonance structures and is defined by Expression (7)

$$T_{L-d1/2-d2/2} = \begin{pmatrix} \cos k\left(L - \frac{d_1}{2} - \frac{d_2}{2}\right) & i\frac{Z_{air}}{s}\sin k\left(L - \frac{d_1}{2} - \frac{d_2}{2}\right) \\ i\frac{s}{Z_{air}}\sin k\left(L - \frac{d_1}{2} - \frac{d_2}{2}\right) & \cos k\left(L - \frac{d_1}{2} - \frac{d_2}{2}\right) \end{pmatrix}. \tag{7}$$

2. The soundproof structure body according to claim 1, wherein a resonance frequency of the resonance structure located on the upstream side in the waveguide forward direction is set to be different from a resonance frequency of the resonance structure located on a downstream side, out of the two resonance structures.

3. The soundproof structure body according to claim 1, wherein a resonance frequency of the resonance structure located on the upstream side in the waveguide forward direction is higher than a resonance frequency of the resonance structure located on a downstream side, out of the two resonance structures.

4. The soundproof structure body according to claim 1, wherein in a case where a wavelength of the resonance frequency f0 is denoted by λ(f0), the interval L satisfies L<λ(f0)/4.

5. The soundproof structure body according to claim 1, wherein the two resonance structures are integrated.

6. The soundproof structure body according to claim 1, wherein the at least two resonance structures are three or more resonance structures.

7. The soundproof structure body according to claim 1, wherein at least one resonance structure of the at least two resonance structures is a Helmholtz resonance structure.

8. The soundproof structure body according to claim 1, wherein at least one resonance structure of the at least two resonance structures is a film resonance structure.

9. The soundproof structure body according to claim 1, wherein at least one resonance structure of the at least two resonance structures is an air column resonance structure.

10. The soundproof structure body according to claim 1, wherein with respect to a wavelength λ(f0) of a frequency satisfying Expression (1), the cross-sectional area S of the opening tube line satisfies $S<\pi(\lambda/2)^2$.

* * * * *